US011478072B2

(12) United States Patent
Lundin et al.

(10) Patent No.: US 11,478,072 B2
(45) Date of Patent: Oct. 25, 2022

(54) COLLAPSIBLE ADJUSTABLE HEIGHT TABLE

(71) Applicant: EVO Inventions LLC, Newark, DE (US)

(72) Inventors: Christopher Lundin, Newark, DE (US); Evan Einbender Aamodt, Philadelphia, PA (US); Michael A. Dotsey, Chester Springs, PA (US); Noah E. Dingler, Phoenixville, PA (US); Erin H. Morrissey, Mont Clare, PA (US); Jonathan N. Tackie, Murrysville, PA (US)

(73) Assignee: EVO INVENTIONS LLC, Newark, DE (US)

( * ) Notice: Subject to any disclaimer, the term of this patent is extended or adjusted under 35 U.S.C. 154(b) by 0 days.

(21) Appl. No.: 16/991,606

(22) Filed: Aug. 12, 2020

(65) Prior Publication Data

US 2021/0052065 A1 Feb. 25, 2021

Related U.S. Application Data

(60) Provisional application No. 62/979,586, filed on Feb. 21, 2020, provisional application No. 62/888,725, filed on Aug. 19, 2019.

(51) Int. Cl.

| | |
|---|---|
| ***A47B 9/16*** | (2006.01) |
| ***A47B 3/02*** | (2006.01) |
| ***D06F 81/02*** | (2006.01) |

(52) U.S. Cl.

CPC ..... *A47B 9/16* (2013.01); *A47B 3/02* (2013.01); *D06F 81/02* (2013.01); *A47B 2003/025* (2013.01)

(58) Field of Classification Search

CPC .... A47B 9/16; A47B 3/00; A47B 3/02; A47B 3/0815; A47B 3/08; A47B 3/0809; A47B 3/091; A47B 3/0818; A47B 2003/025; A47B 2003/0821; A47B 2003/045; A47B 2200/0025; A47B 2200/0036; A47B 3/0913; A47B 3/0912; A47B 3/0916; A47B 9/20; A47B 2200/0051; A47B 2200/0011; A47B 2200/002; A47B 2200/0035;

(Continued)

(56) References Cited

U.S. PATENT DOCUMENTS 1,202,660 A * 10/1916 Breault ..... A47B 3/02 108/118

2,693,652 A 11/1954 Kutz (Continued)

FOREIGN PATENT DOCUMENTS

EP 2537443 * 12/2012
FR 2253347 * 6/1975

(Continued)

OTHER PUBLICATIONS

Search Report dated Aug. 12, 2020 by the Intellectual Property Office in (ROC) Taiwan Design Patent Application No. 109300776.

(Continued)

*Primary Examiner* — Janet M Wilkens
(74) *Attorney, Agent, or Firm* — Barnes & Thornburg LLP

(57) ABSTRACT

A collapsible, adjustable height table with a compact folded configuration and a range limiter to secure selected table heights.

17 Claims, 27 Drawing Sheets

(58) Field of Classification Search
CPC ..... A47B 2200/0055; A47B 2009/185; A47B 21/02; D06F 81/02; D06F 81/04; D06F 81/00; B29L 2031/448
USPC ..... 108/116, 115, 117, 118, 120; 403/400, 403/95, 113, 188; 248/164, 431, 432
See application file for complete search history.

(56) References Cited

U.S. PATENT DOCUMENTS

| | | | | |
|---|---|---|---|---|
| 3,018,574 | A * | 1/1962 | Munson | D06F 81/04 108/117 |
| D493,310 | S | 7/2004 | Ashby | |
| D598,213 | S | 8/2009 | Frederking | |
| D668,077 | S | 10/2012 | Edi | |
| 8,667,907 | B2 | 3/2014 | Grace | |
| 9,119,465 | B2 | 9/2015 | Grace | |
| 11,109,671 | B1 * | 9/2021 | Liu | A47B 9/16 |
| 2010/0209182 | A1 * | 8/2010 | Tsai | A47B 3/02 403/188 |
| 2011/0101716 | A1 | 5/2011 | Nolte et al. | |
| 2015/0108296 | A1 * | 4/2015 | Van Dyne | A47B 3/02 248/164 |
| 2018/0255919 | A1 | 9/2018 | Swartz et al. | |

FOREIGN PATENT DOCUMENTS

| | | | |
|---|---|---|---|
| GB | 2394965 | A | 5/2004 |
| JP | D1277260 | A | 7/2006 |
| KR | 20110006306 | * | 6/2011 |
| KR | 300947391000 | A | 3/2018 |
| TW | 543408 | A | 7/2003 |
| TW | M403256 | A | 5/2011 |
| WO | 2010001121 | A1 | 1/2010 |

OTHER PUBLICATIONS

International Search Report and Written Opinion issued by the International Searching Authority dated Jan. 27, 2021 in International Patent Application No. PCT/US2020/045916.

* cited by examiner

COLLAPSIBLE ADJUSTABLE HEIGHT TABLE

CROSS REFERENCE TO RELATED APPLICATIONS

This application claims priority to U.S. Provisional Application 62/979,586, filed 21 Feb. 2020, entitled Collapsible Adjustable Height Table, and U.S. Provisional Application 62/888,725, filed 19 Aug. 2019, entitled Collapsible Adjustable Height Table, both of which are incorporated herein by reference.

FIELD

The present disclosure relates to collapsible, adjustable height tables having extendable legs.

BACKGROUND

Compactness of conventional collapsible, adjustable height tables often corresponds to the distance of the vertical excursion. For example, the legs of an ironing board may be a limiting factor in the minimum width of the collapsed apparatus. If the ironing surface is reduced in size, the legs would extend beyond the width of the ironing surface when the apparatus was collapsed, and thus, the overall dimensions of the collapsed apparatus would not be reduced. If the length of the legs is shortened, the desired ironing board height would not be achieved. Thus, with ironing boards, and other folding, adjustable apparatuses, such as folding tables, desks and standing tables, the dimensions of the collapsed apparatus are dictated by the maximum height of the apparatus.

SUMMARY

A collapsible, adjustable height table is disclosed that provides a reduced folded size compared to conventional collapsible, adjustable tables and other apparatuses. This multi-purpose apparatus may include a gas compression spring, or similar mechanism, to facilitate extending the table to desired heights. The novel telescoping legs enable use of a central pivot about which the legs rotate to fold and expand the table, wherein the pivot apparatus does not limit the length of the legs, and therefore does not limit the height of the table.

The term "table" is used herein for simplicity in illustrative embodiments, but it is noted that the mechanisms, such as the leg assemblies, locking mechanisms, pivot apparatuses and release mechanisms can also be used in other collapsible, folding apparatuses, which are included in the scope of disclosed apparatuses.

DESCRIPTION OF DRAWINGS

The detailed description refers to the accompanying figures, which depict illustrative embodiments.

DETAILED DESCRIPTION OF EMBODIMENTS

The figures and descriptions provided herein may have been simplified to illustrate aspects that are relevant for an understanding of the described apparatuses, while eliminating, for the purpose of clarity, other aspects that may be found in typical devices, systems, and methods. Those of ordinary skill may recognize that other elements or operations may be desirable or necessary to implement the apparatuses described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that could be implemented by those of ordinary skill in the art.

FIGS. 1A-D, 2A-C, 3A-B, 4A-B depict an illustrative collapsible, folding table 100 in various configurations. FIGS. 1A-D, 2A-B, 3A-B, 4A-B show simplified depictions of various illustrative configurations. Optionally, stops, detents or other mechanisms may be incorporated to signal when a table is at a particular height, and/or maintain it in the desired position. These heights may represent coffee table, sitting table and standing table configurations, or they may include additional height options or fewer height options.

Figure 1A:
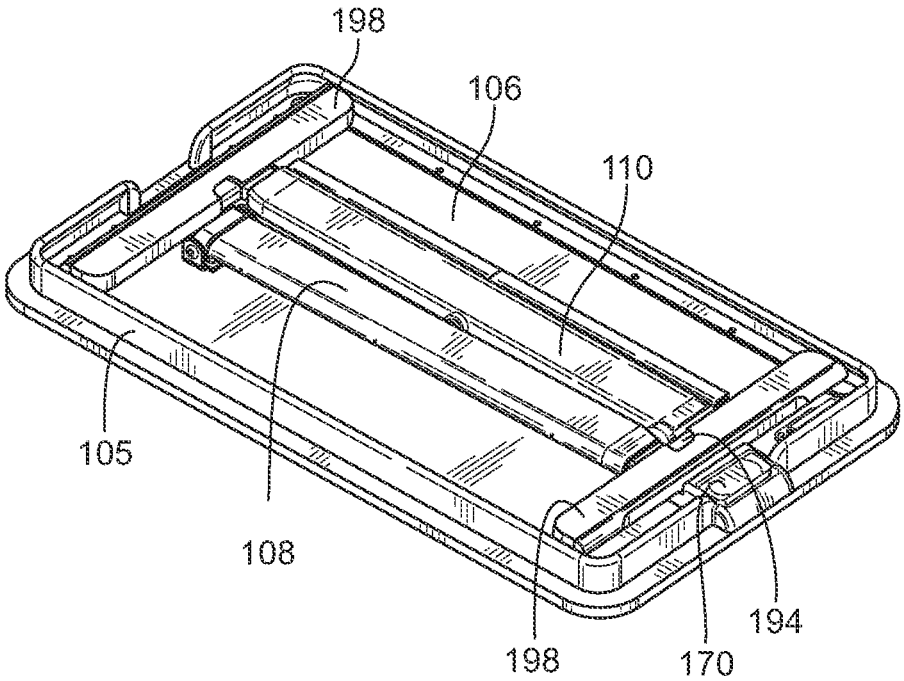
FIGS. 1A-C depict a perspective view, bottom view and side view, respectively, of an adjustable height, foldable table in a folded position.
Figure 1B:
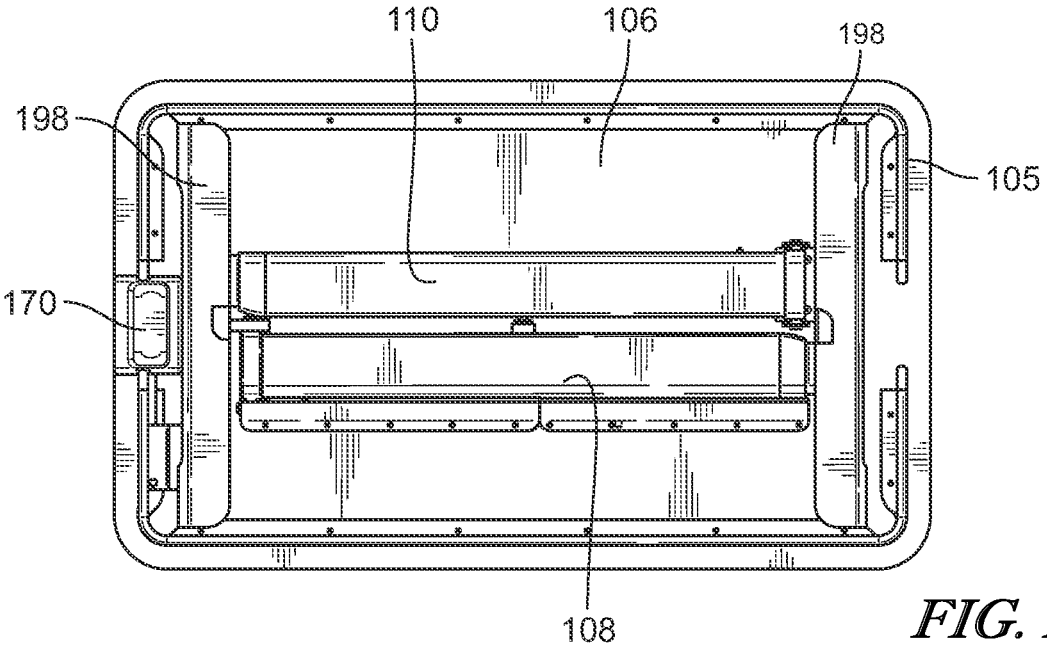
Figure 1C:
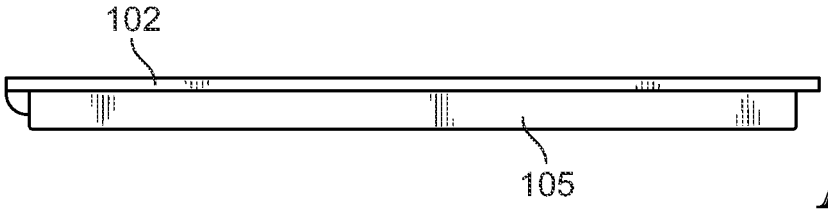
Figure 1D:
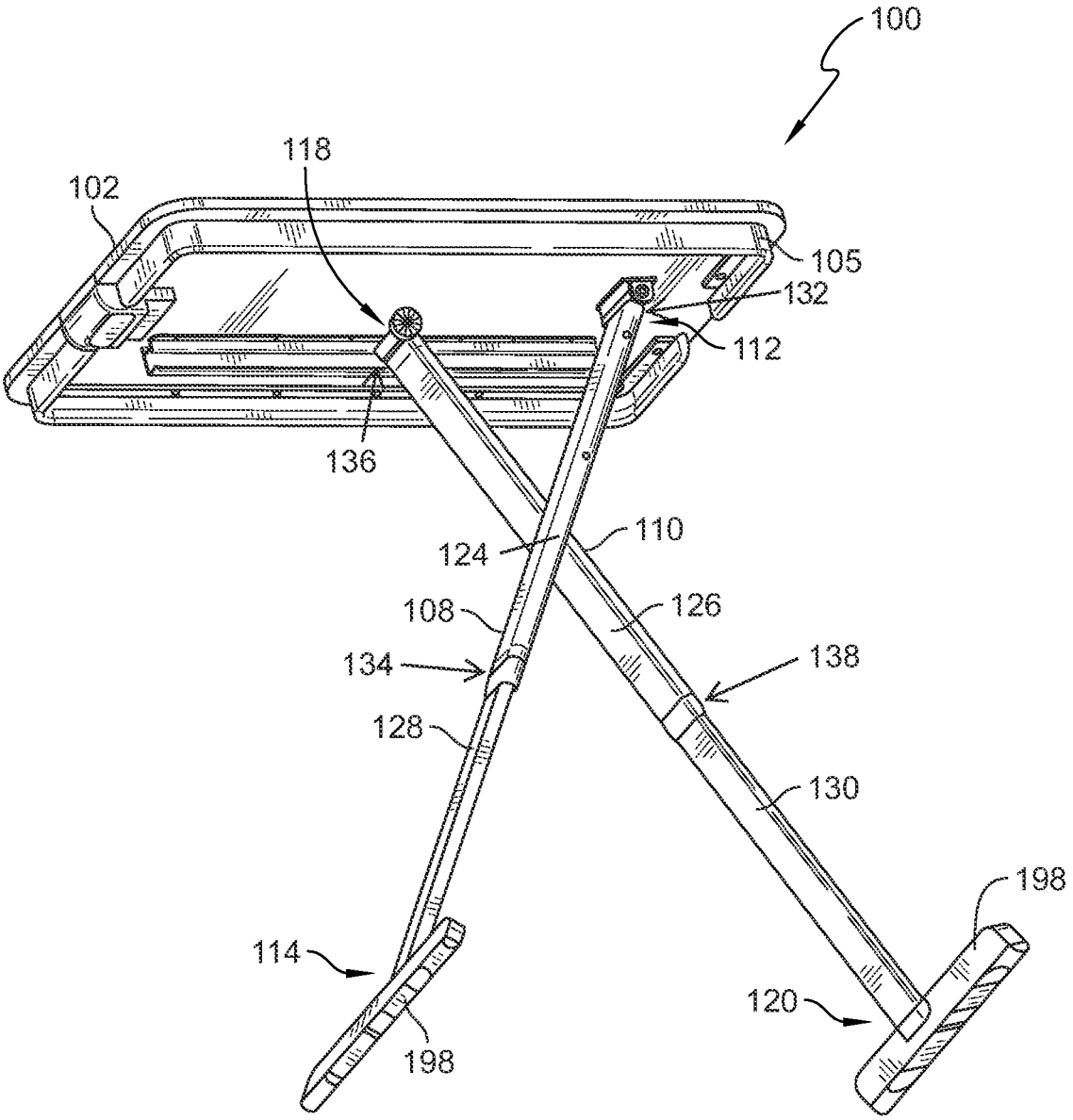
FIG. 1D depicts a perspective bottom view of a table in a deployed position.
Figure 2A:
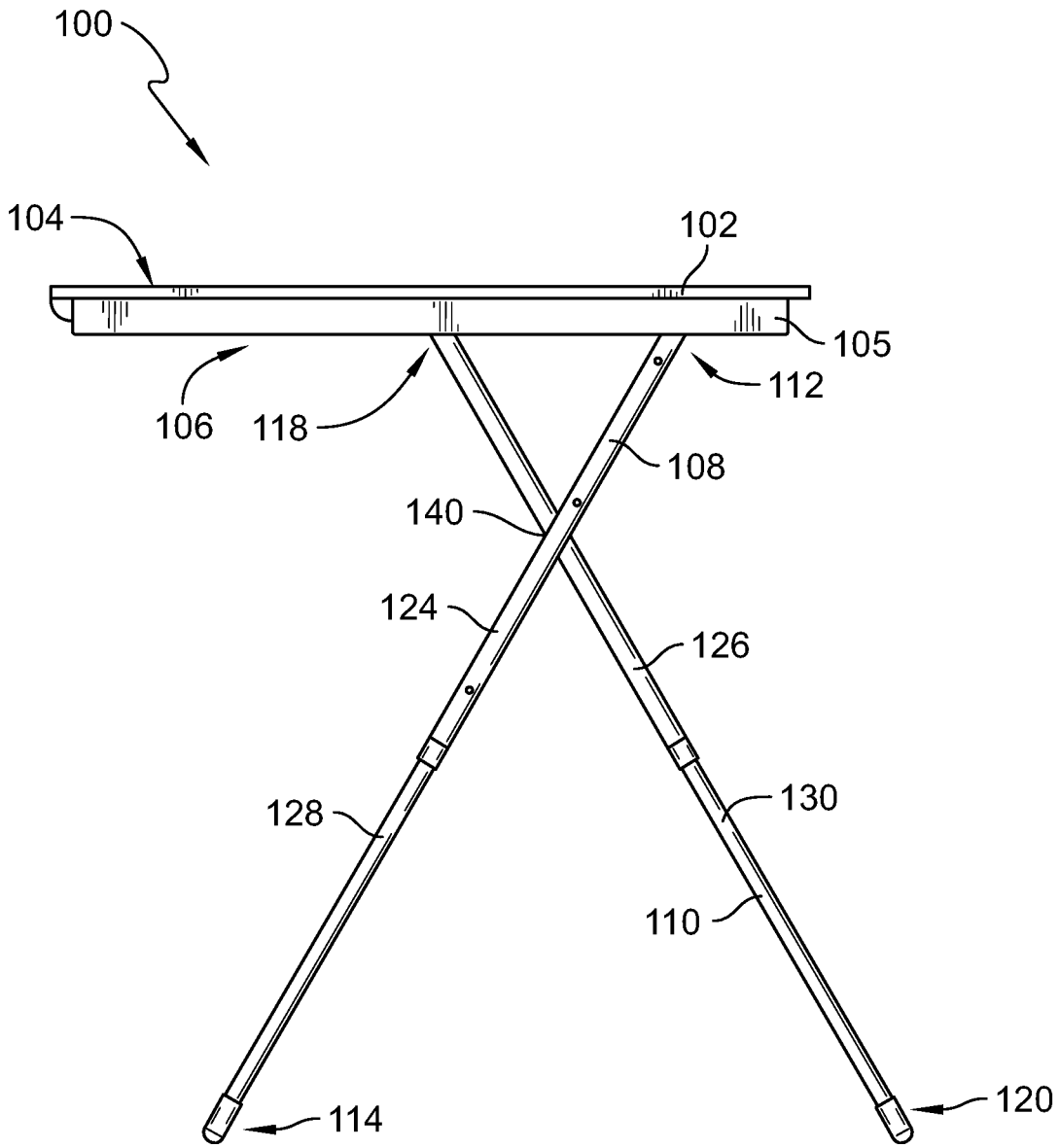
FIGS. 2A-C depict a side view, a perspective bottom view, and a perspective upright view, respectively, of the adjustable height, foldable table elevated to or toward its maximum height.
Figure 2B:
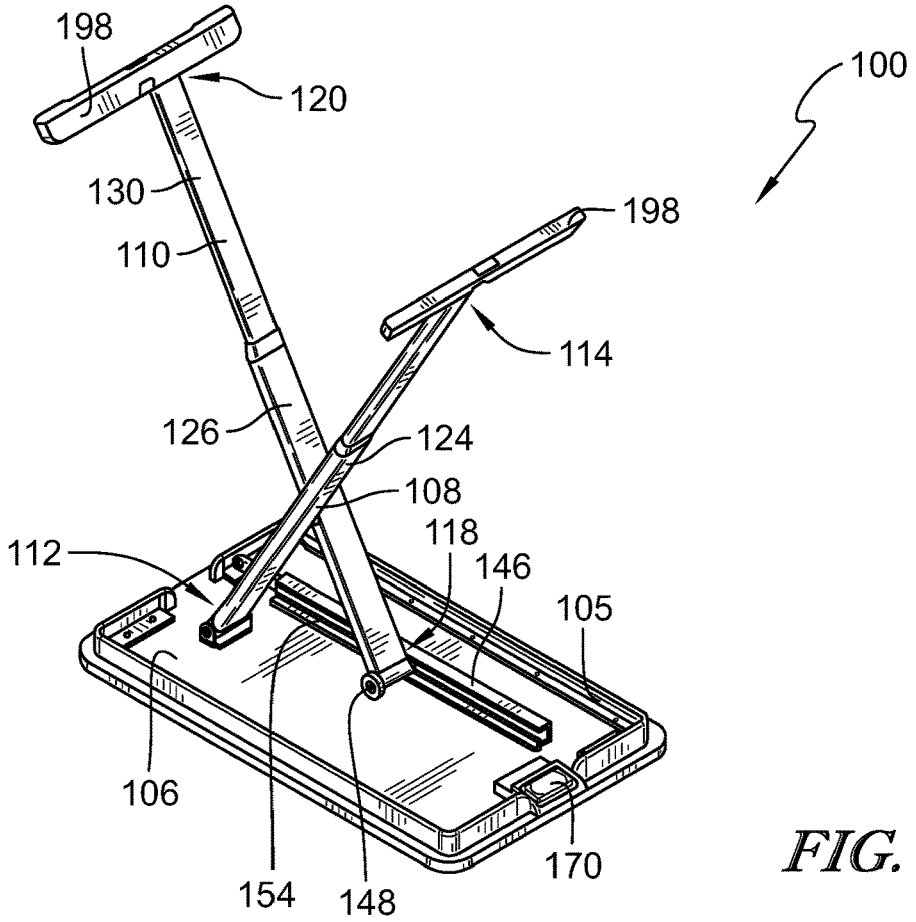
Figure 2C:
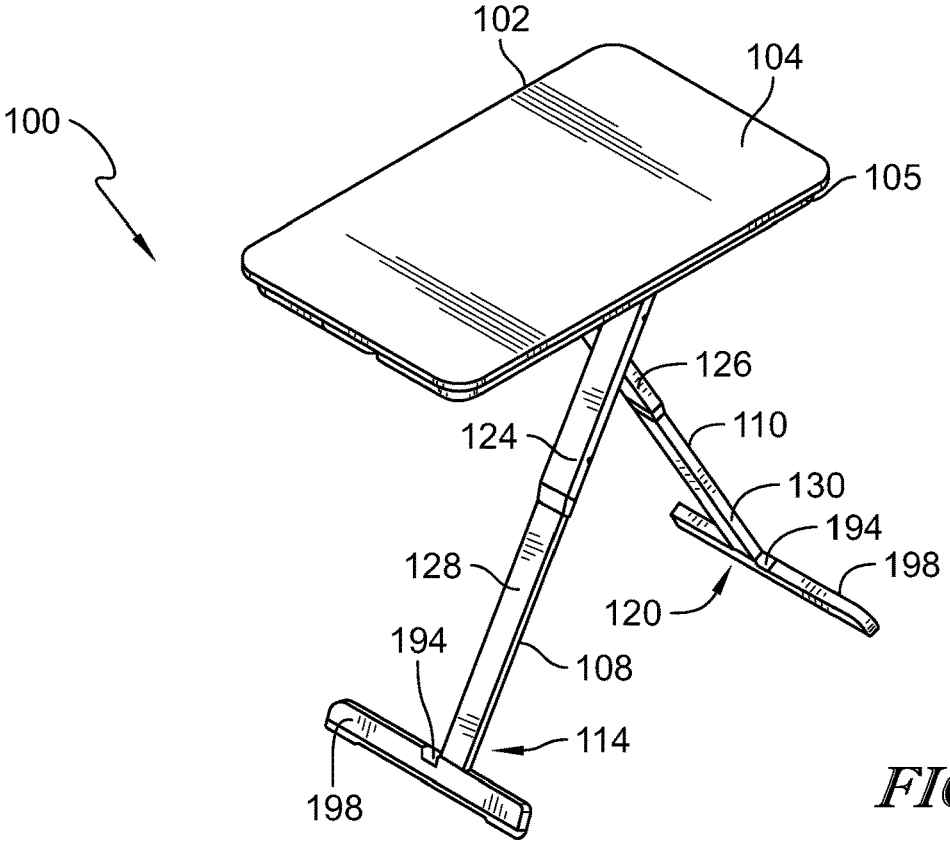
Figure 3A:
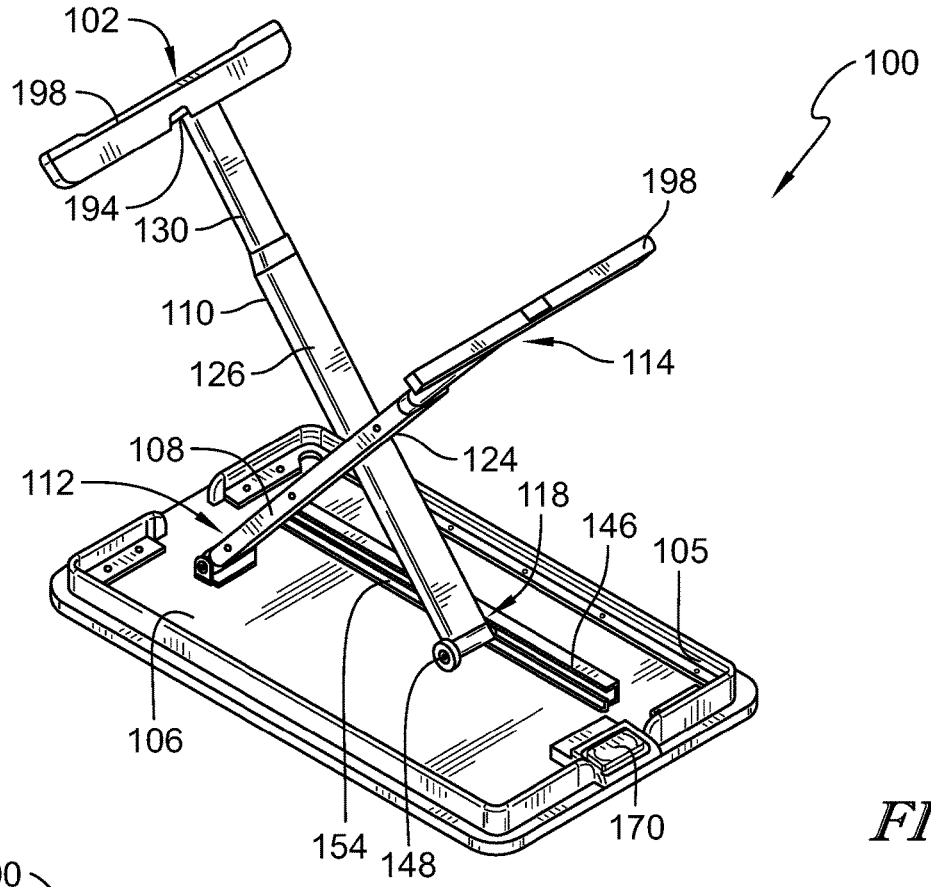
FIGS. 3A-B depict a side view and a perspective bottom view, respectively, of the adjustable height, foldable table elevated to or toward its maximum height.
Figure 3B:
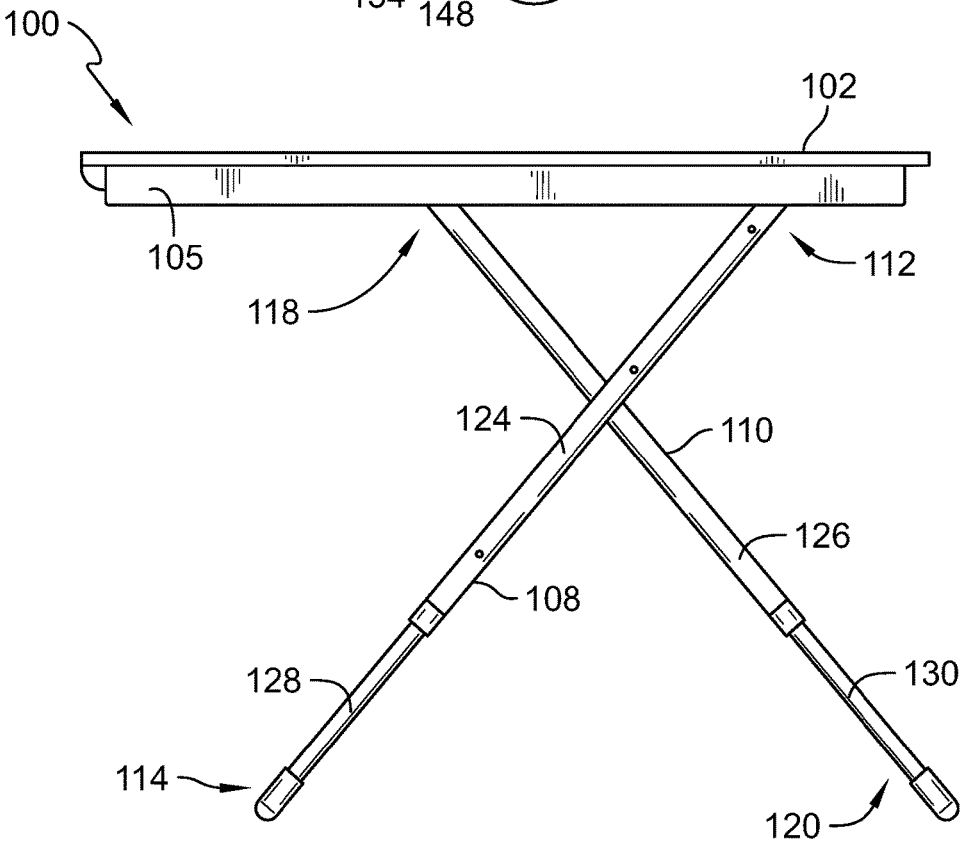
Figure 4A:
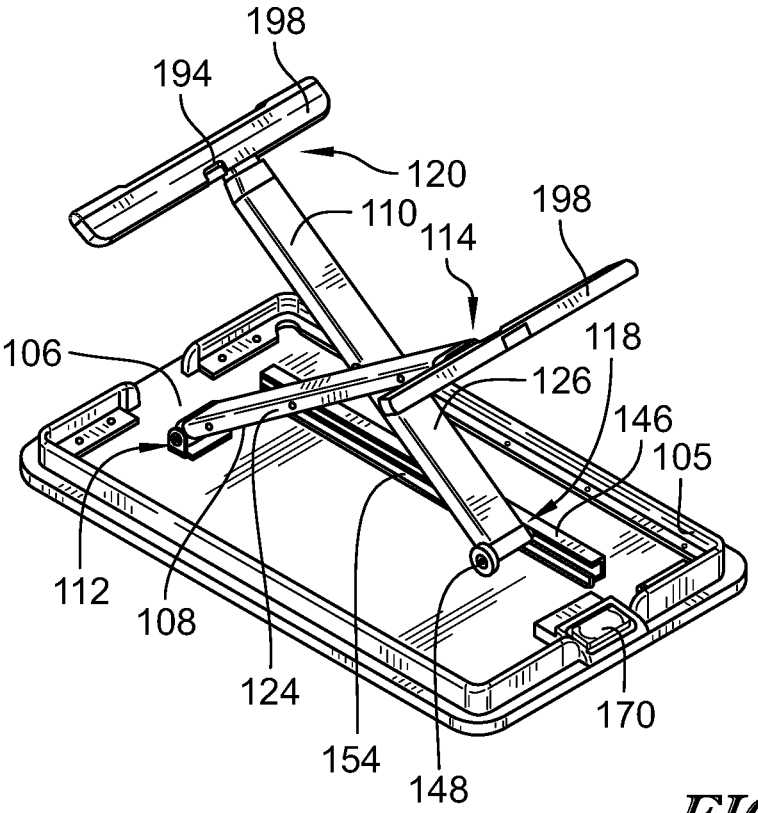
FIGS. 4A-B depict a side view and a perspective bottom view, respectively, of the adjustable height, foldable table elevated to a lower height than depicted in the previous figures.
Figure 4B:
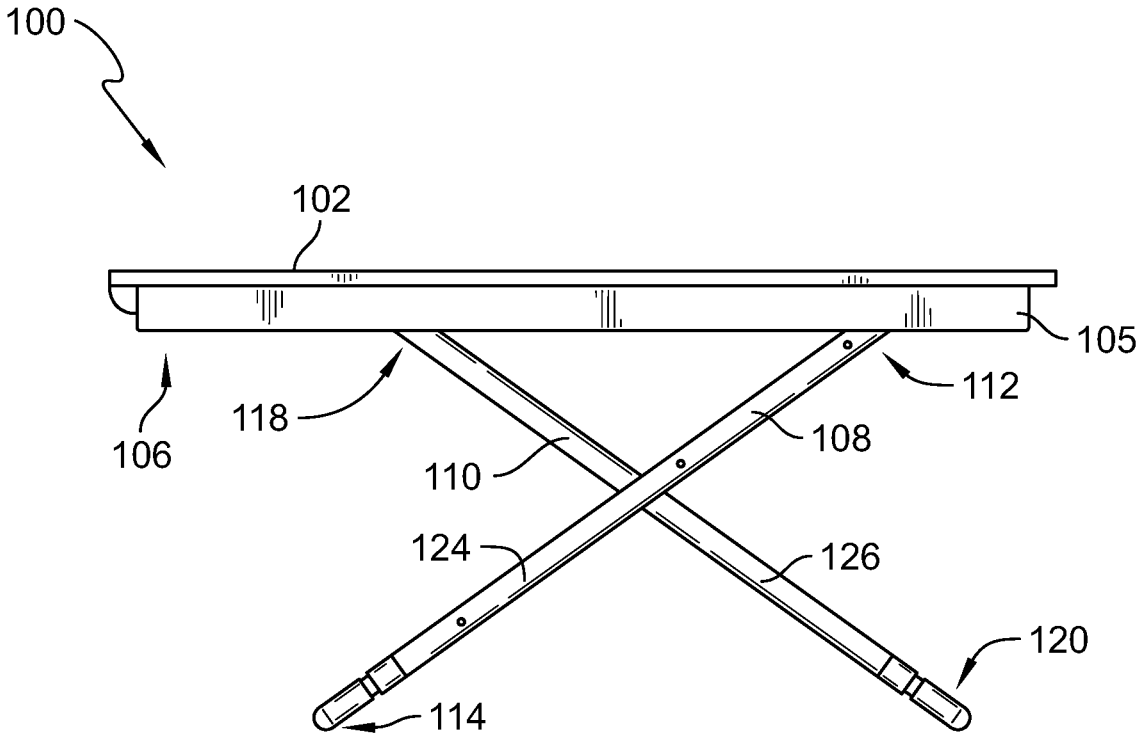

FIGS. 1A-C depict a perspective view, bottom view and side view, respectively, of table 100 in a folded position. FIG. 1D depicts a perspective bottom view of a table in a deployed position. FIGS. 2A-C depict a side view, a perspective bottom view, and a perspective upright view, respectively, of table 100 elevated to or toward its maximum height. This height may be used, for example, as a standing table. FIGS. 3A-B depict a side view and a perspective bottom view, respectively, of table 100 elevated to or toward its maximum height. This height may be used, for example, as a sitting table. FIGS. 4A-B depict a side view and a perspective bottom view, respectively, of table 100 elevated to a lower height than depicted in the previous figures. This height may be used, for example, as a coffee table. In each case, the height of table 100 is temporarily locked or secured in place. Reference to specific heights or table uses herein is for illustrative purposes and does not limit the scope of the invention.

The height of table 100 may be adjusted by scissoring the legs and/or extending them. The height of table 100 may be limited to a number of specific heights or may be continually adjustable between a minimum and maximum height.

Table 100 has a table top 102 having a top surface 104 and a bottom surface 106. An apron 105 extends downward from bottom surface 106. A first leg 108 and a second leg 110 extend from table top 102. First leg 108 and second leg 110 may extend directly from table top bottom surface 106, or may have components disposed therebetween, for example to facilitate attachment either fixedly or slidably.

First leg 108 has a top end 112 and a bottom end 114, and a pivot 122 located between top end 112 and bottom end 114. Similarly, second leg 110 has a top end 118 and a bottom end 120, and a pivot 116 located between the top end 118 and the bottom end 120. First leg 108 and second leg 110 are attached at pivots 116 and 122. Pivots 116 and 122 (identified generally in FIG. 6A-B) may be, for example, pivot assemblies 212A, 212B as described below, or other pivot connections that allow first leg 108 and second leg 110 to scissor with respect to one another and are compatible with the folding mechanisms employed.

As can be seen in FIG. 2A with table 100 at or near its maximum height, first leg 108 and second leg 110 are telescopic. Each of first leg 108 and second leg 110 comprises two sections, a sleeve section 124, 126 and an extension section 128, 130, wherein extension section 128, 130 is internally slidable in sleeve section 124, 126. Sleeve section 124 is part of first leg 108, which is the leg that is hinged to table top 102. Sleeve section 126 is part of second leg 110, which is the leg that is slidable with respect to table top 102. Second leg 110 may be resistively, slidable with respect to table top 102 to the extent necessary for safety or ease of folding and expanding, for example. Second leg 110 may also be biased to resistively slide in increments.

Figure 5B:
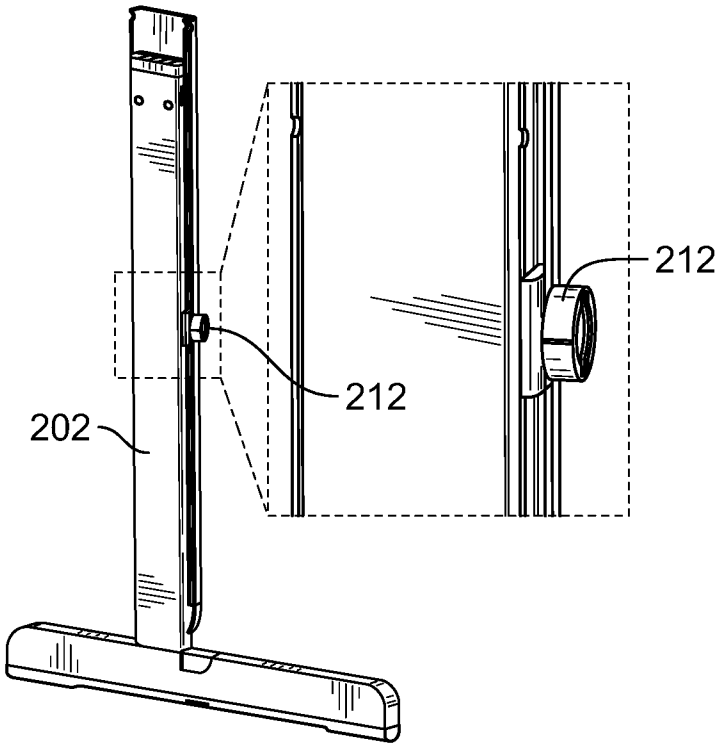
FIGS. 5A-B depict an illustrative leg assembly for the adjustable height, foldable table.
Figure 5A:
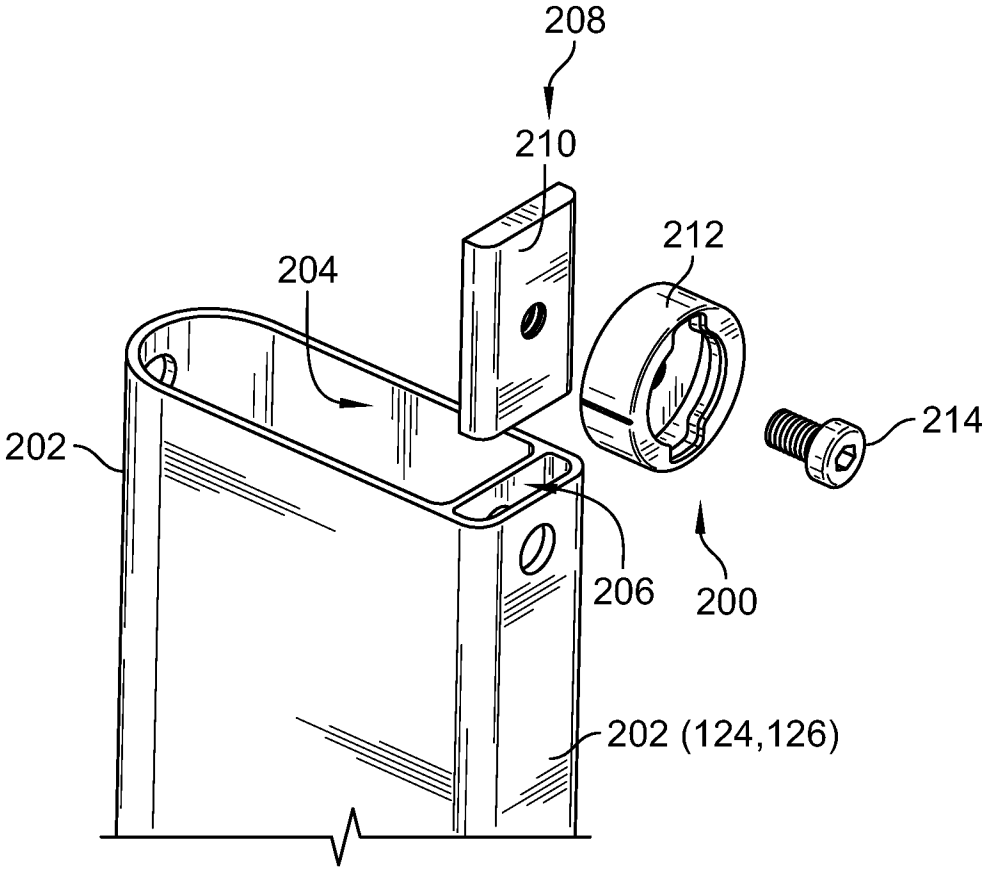

FIGS. 5A-B depict an illustrative leg assembly 200, which can be incorporated in either first leg 108 or second leg 110. Leg assembly 200 is shown with respect to a compartmentalized sleeve section 202, such as sleeve sections 124, 126. Compartmentalized sleeve section 202 is divided longitudinally into a first larger enclosed space 204 and an adjacent second smaller enclosed space 206. Leg extension sections 128, 130 are dimensioned to telescope into the large enclosed space 204, contained in each of sleeve sections 124, 126, whereas small enclosed space 206 houses the fastener for the leg pivot. Advantageously, this compartmentalized configuration of sleeve section 202 allows the telescoping leg to pass through the pivot axis. Although the two enclosed spaces are referred to as "small" and "large" or "smaller" and "larger," they need not have that relative dimensional relationship. More broadly, one compartment must be large enough to accommodate a leg extension and the other a fastening component to secure the pivot to the leg, to allow the leg extension to slide past the pivot. This may provide a greater degree of compactness of the folded configuration dimensions. It is further noted that the compartments need not be fully enclosed. For example, the smaller or second enclosed space merely needs to allow for fastening of a pivot assembly, and thus, may only need to occupy a small distance along the sleeve.

Figures 6A, 6B:
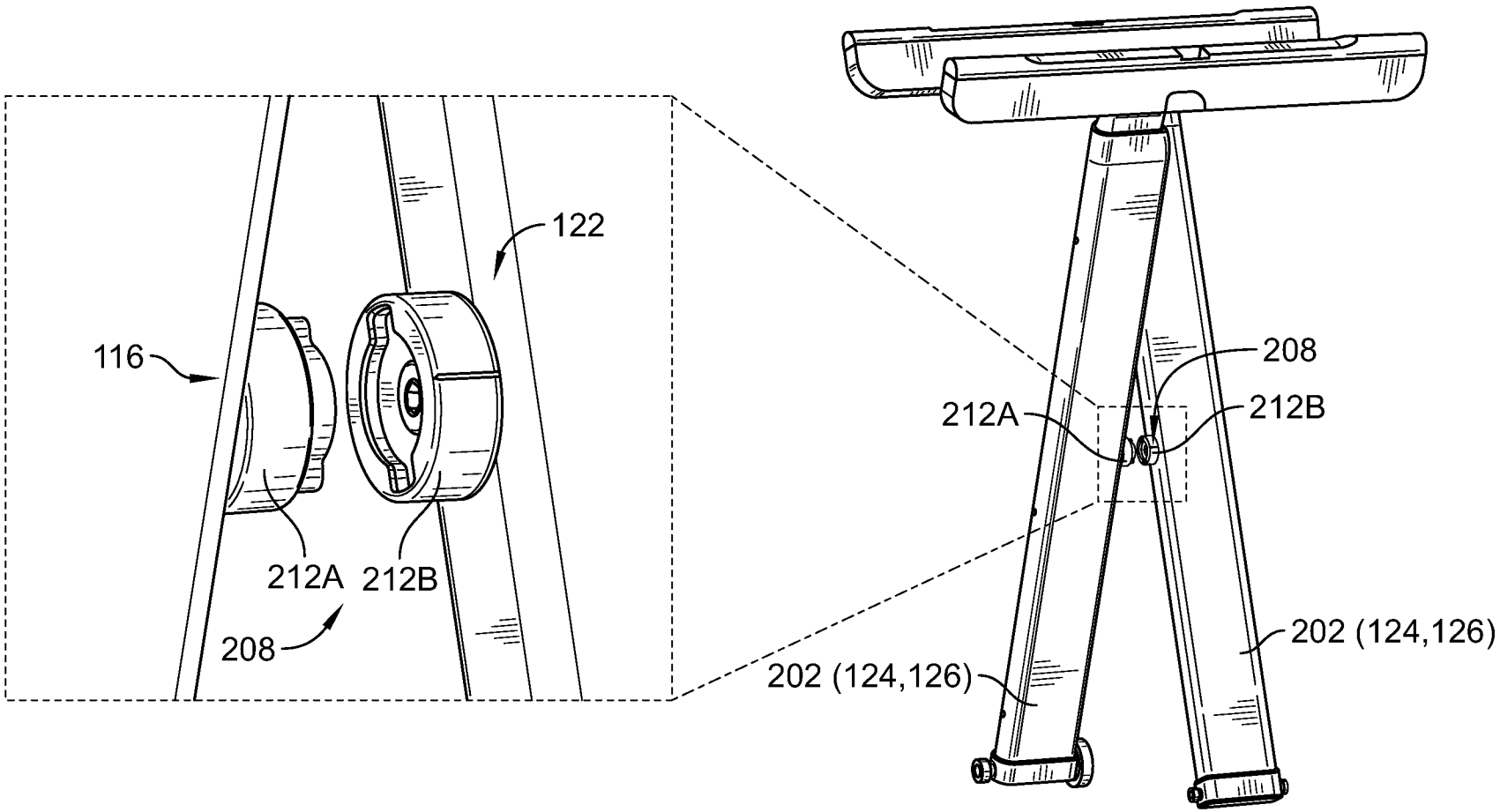
FIGS. 6A-B depict an illustrative pivot apparatus that connects the table legs to one another.

FIGS. 6A-B depict an illustrative pivot apparatus 208 that extends into the smaller enclosed space 206 of each of first leg sleeve section 124 and second leg sleeve section 126. FIG. 6A shows pivot apparatus 208 positioned on compartmentalized sleeve 202. FIG. 6B is an enlargement of pivot apparatus 208. An expanded view of components of pivot apparatus 208 are also shown in FIG. 5A. Pivot apparatus 208 includes a nut 210, which fits within small enclosed space 206. A pivot assembly 212 is positioned outside of compartmentalized sleeve 202. Nut 210 and pivot assembly 212 are fastened to one another, for example, by a screw 214. Nut 210 may be any shape or material that adequately secures mating pivot assemblies 212A, 212B, such as a plate, disk or other configuration. The term "nut" will be used broadly to include any such component.

Pivot apparatus 208 is attached between a first end 132 of sleeve section 124 and a second end 134 of sleeve section 124, and further attached between a first end 136 of sleeve section 126 and a second end 138 of sleeve section 126. Mating pivot assemblies 212A, 212B, which may be for example, a male or female pivot assembly component. Mating pivot assembly 212A is located on either first leg 108 or second leg 110, and the complementary mating pivot assembly is located on the other of first leg 108 or second leg 110. When engaged, mating pivot assemblies 212A, 212B rotate with respect to one another.

Figures 7A, 7B:
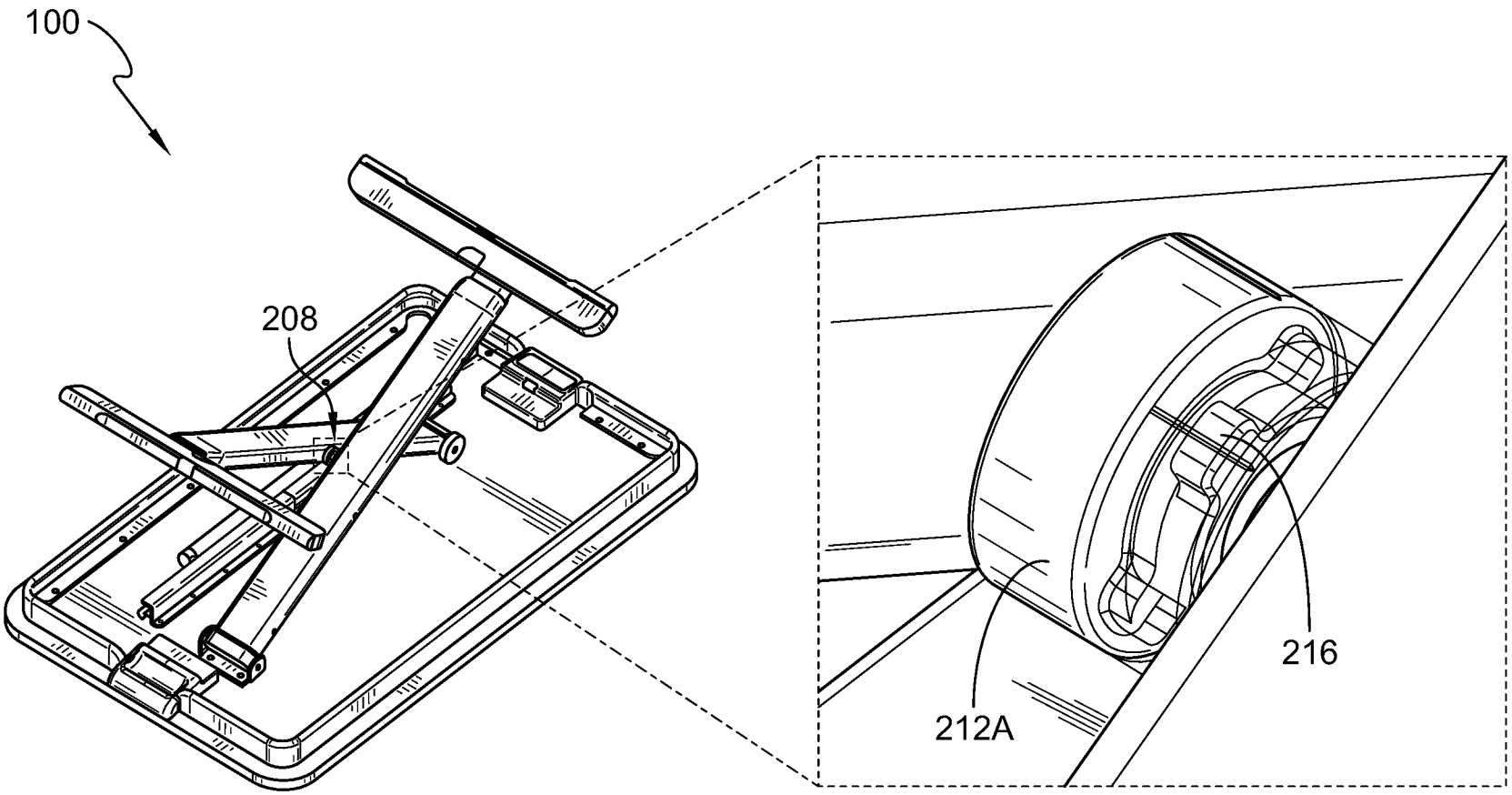
FIGS. 7A-B depict an isometric bottom view of the adjustable height, foldable table and an enlarged view of a mating pivot assembly.

FIG. 7A depicts an isometric view of table 100 from the bottom, showing a portion of pivot apparatus 208. An enlarged view is shown in FIG. 7B and includes a view of a mating pivot assembly 212. A tab 216 is shown in mating pivot assembly 212A male component, which would engage with a female mating pivot assembly 212B female component.

Figure 8:
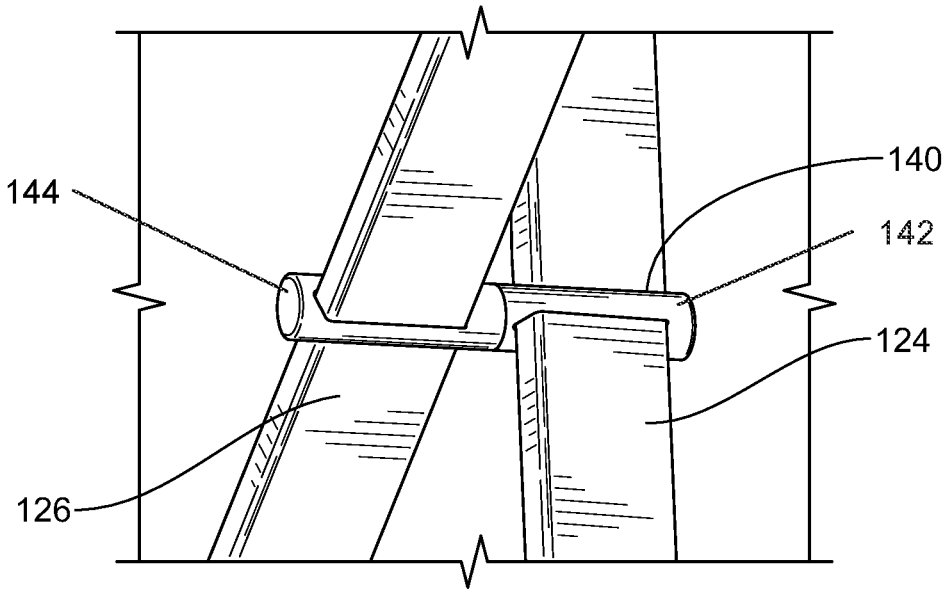
FIG. 8 depicts a pivot assembly housing.

FIG. 8 depicts an optional pivot housing 140. Pivot housing 140 includes a first leg pivot housing component 142 having an opening through which the first leg sleeve component 124 is disposed and a second leg pivot housing component 144 having an opening through which the second leg compartmentalized sleeve component 126 is disposed. The first leg pivot component is rotatably attached to the second leg pivot component. Other configurations of pivot housing may be used that allow for rotation of first leg 108 and second leg 110 with respect to one another, including having the housing portions integral with the legs.

In an illustrative embodiment, each leg extension section 128, 130 has a length allowing it to extend within its associated sleeve component 124, 126 past pivot apparatus 208. This is made possible by the compartmentalized structure of sleeve components 124, 126, which allows the telescoping parts to be accommodated within first enclosed space 204, while second enclosed space 206 accommodates pivot apparatus 208, thereby keeping the parts separated.

Figure 9:
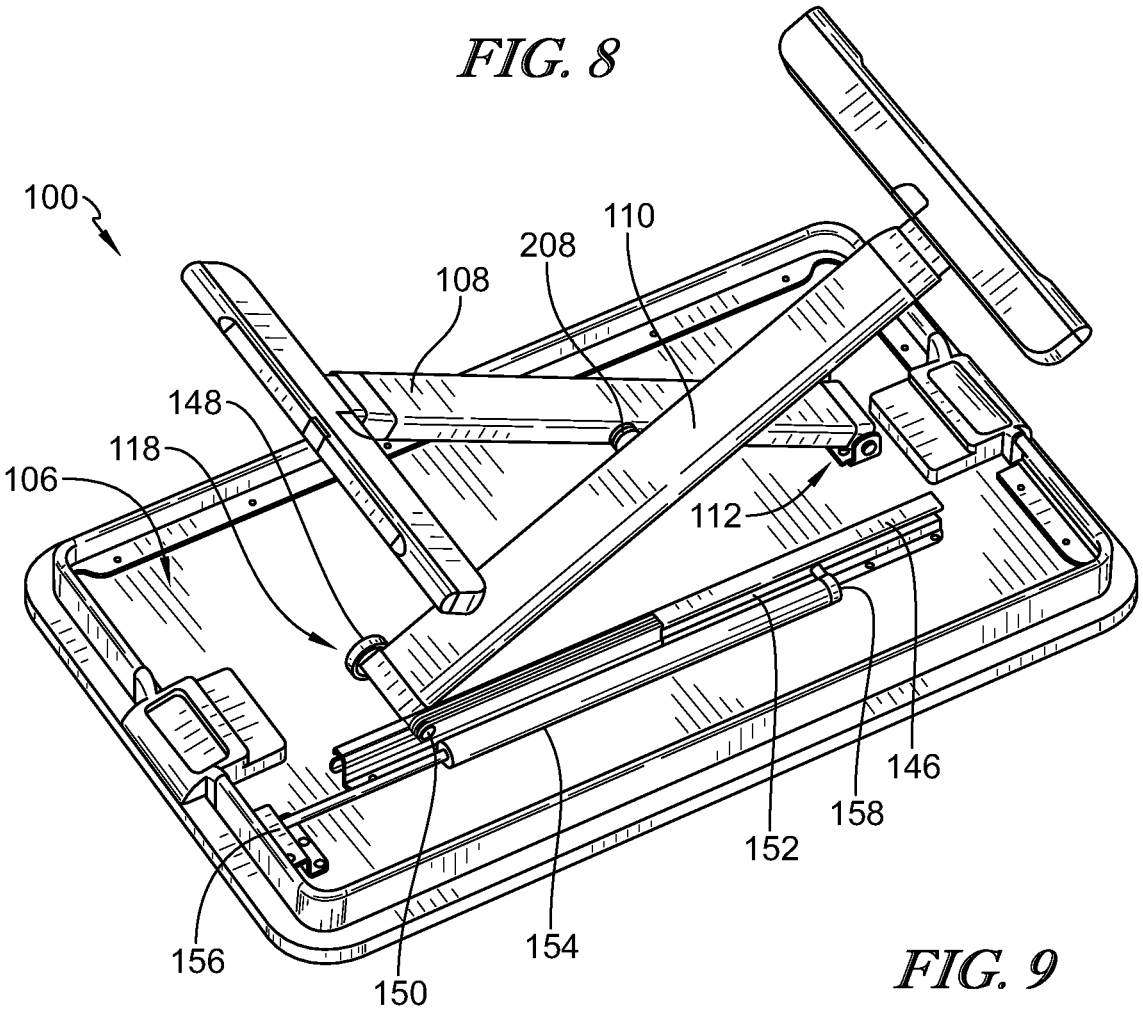
FIG. 9 depicts a bottom isometric view of the adjustable height, foldable table showing the lifting mechanism.
Figure 10B:
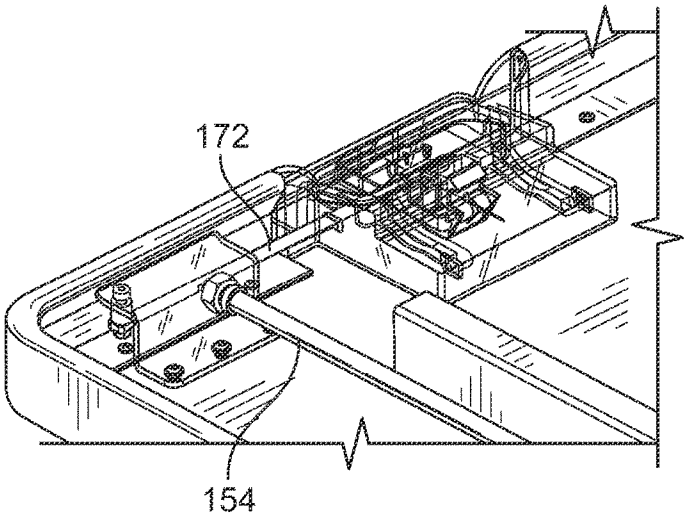
FIGS. 10A-D depict the components of a locking and release mechanism to secure the adjustable height, foldable table in a folded position.
Figure 10D:
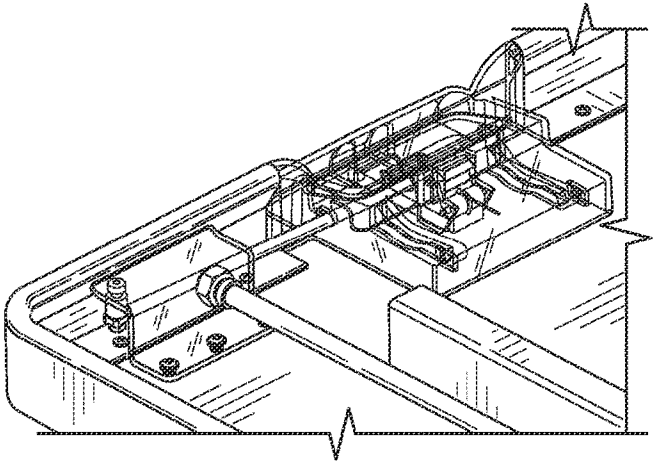
Figure 10A:
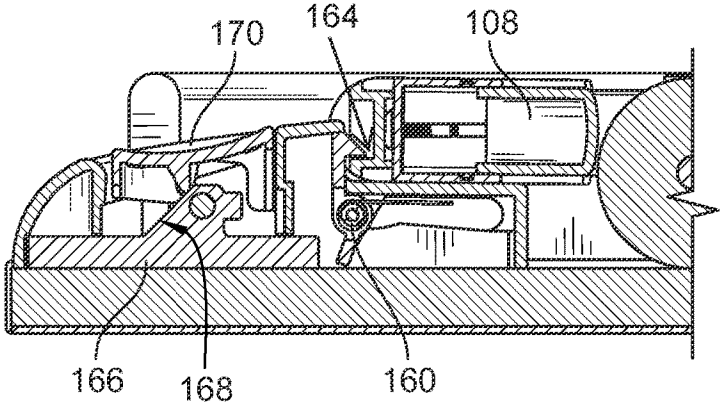
Figure 10C:
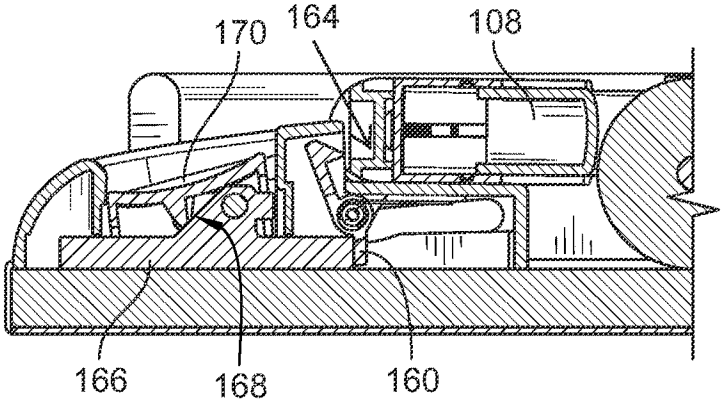

FIG. 9 depicts a bottom isometric view of table 100 having a lifting mechanism 101, which may comprise a lift assist component such as a spring apparatus, or may be operated merely by a user applying a preferably light force to achieve the desired height. First leg top end 112 is fixedly attached to table top bottom surface 106. Second leg top end 118 is slidably attached to table top bottom surface 106. Pivot apparatus 208 is configured to attach first leg 108 to second leg 110 at first leg pivot 116 and second leg pivot 122.

A track 146 is attached to table top bottom surface 106. A first wheel 148 is attached to second leg top end 118 and allows second leg 110 to slide along table top bottom surface 106. A second wheel 150 is disposed laterally opposite first wheel 148 and is attached to second leg top end 118. Second wheel 150 is disposed within the track 146 and is slidable along track 146. Second wheel 150 is rotationally attached to a pull bar 152. A gas compression spring 154 having a first end 156 and a second end 158 is fixedly attached at its first end 156 to table top bottom surface 106 or an extension therefrom. Gas compression spring second end 158 is fixedly attached to pull bar 152, thereby forcing spring 154 to compress when table 100 is collapsed and extend as table 100 is raised.

In illustrative embodiments, gas compression spring 154 is positioned off-center between the opposite sides of table top bottom surface 106. This configuration facilitates table 100 folding flat or at least with a minimum depth as measure from table top surface 104. Table 100 may be configured so folded components are within the depth of apron 105. This may facilitate storing table 100, such as underneath a bed or sofa, as it may slide more easily and table components are shielded from catching on objects. It remains adjacent, instead of under, various table components such as first leg 108 and second leg 110. Although reference is made to compression spring 154, a tension spring may be employed instead. For example, the mechanism comprising pull bar 152 and compression spring 154 can be replaced with a tension spring.

Alternate arrangements and components may be used to facilitate expanding the table to increasing heights, for example, other types of springs, bands, hydraulic devices or pneumatic devices and associated components. Embodiments of the invention also include tables and other collapsible, adjustable height apparatuses that do not have lift assist mechanisms.

FIGS. 10A-D depict the components of a locking and release mechanism to secure table 100 in a folded position. FIGS. 11A-D show the locking mechanism with illustrative housing components. The locking and release mechanism comprises a storage catch 160 pivotably attached to table top 102. Storage catch 160 has a hook 162. An indent 164 in first leg 108 at first leg bottom end 114 is complementary to storage catch hook 162 to the extent necessary for hook 162 to engage indent 164. Storage catch 160 is biased to engage first leg bottom indent 164. A shuttle 166 is slidably attached in the locking and release mechanism from a first position engaging storage catch 160 and countering the bias of storage catch 160 toward first leg bottom indent 164 to unlock first leg bottom 114, and a second position away from the storage catch 160 so as not to affect the bias of storage catch 160 toward first leg bottom indent 164. FIG. 11 shows the locking mechanism engaged with a leg 108 when table 100 is in a folded position.

Shuttle 166 has an angled surface 168. A table release lever 170 is movable toward and away from table top 102 and engaged with shuttle angled surface 168, so as to force shuttle 166 to move away from storage catch 160 according to the engagement position of table release lever 170 with respect to shuttle angled surface 168. The locking and release mechanism further includes a release rod 172 configured to release a gas spring release component to allow gas spring 154 to expand, thereby elevating table 100.

Figure 11A:
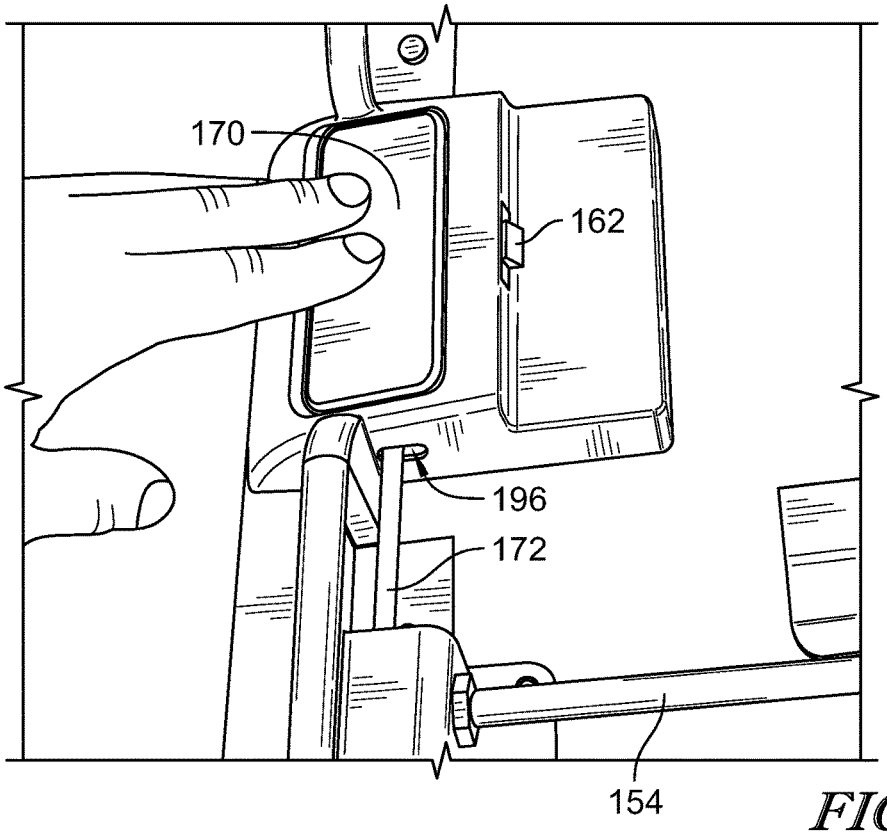
FIGS. 11A-D depict a release mechanism that secures the legs of the adjustable height, foldable table in a folded position when the table is collapsed, and releases the legs to expand the table.
Figure 11B:
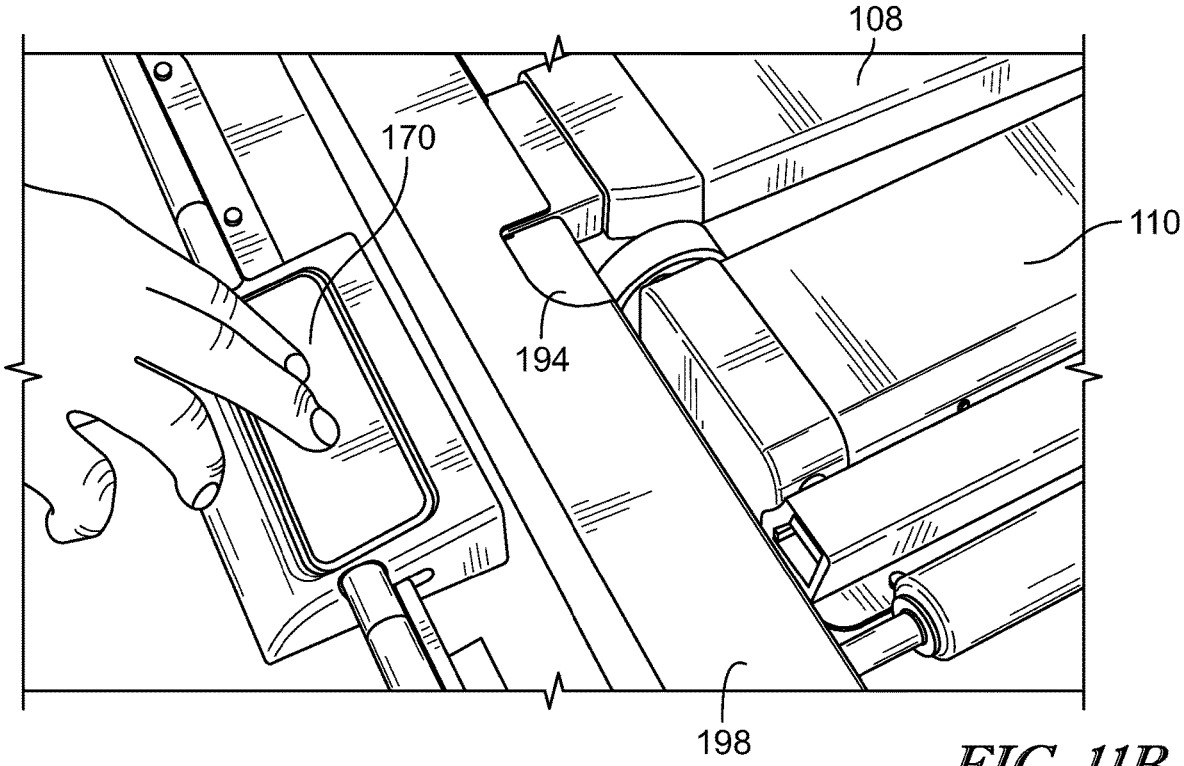
Figure 11C:
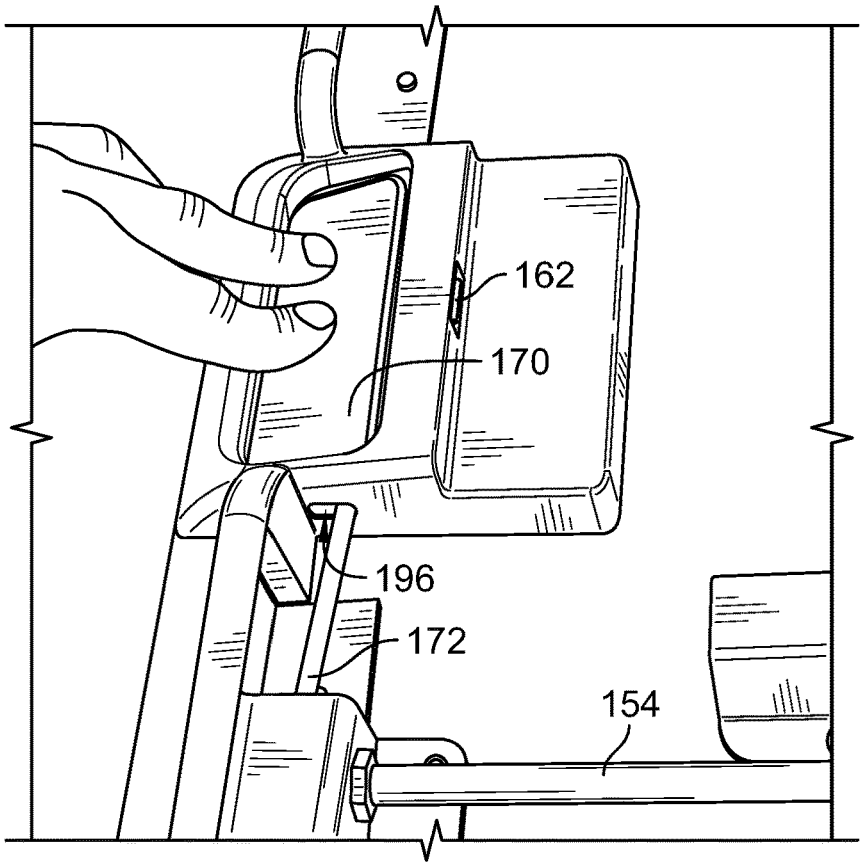
Figure 11D:
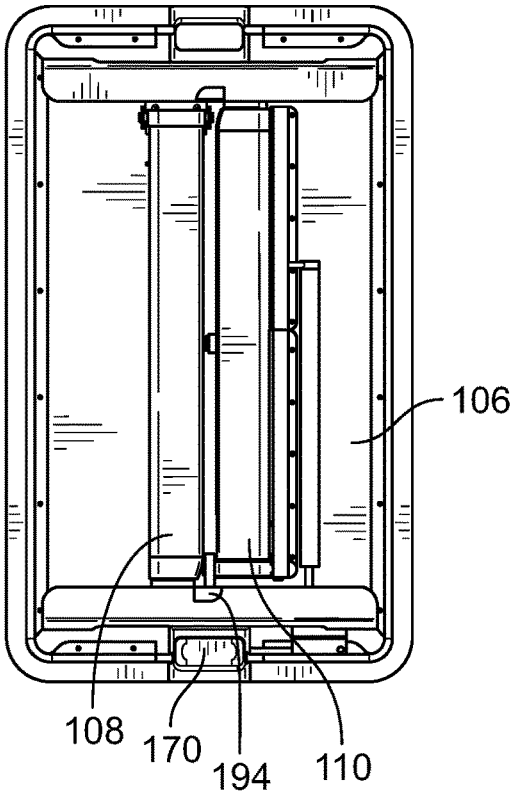

FIGS. 11A-D depict the illustrative table release mechanism that secures legs 108, 110 in a folded position when the table is collapsed, and releases legs 108, 110 to expand the table. FIG. 11A shows table 100 in the expanded position with table release lever 170 shown prior to it being depressed. Table release lever 170 operates hook 162 which is designed to latch onto a table leg. Release rod 172 is also operated by release lever 170. Note the position of release rod 170 in slot 172. As seen in FIG. 11C, when table release lever 170 is depressed, hook 162 is drawn into the housing surrounding table release lever 170. Release rod 172 is forced to an opposing end of slot 196. See the description above of FIGS. 10A-D for additional information regarding the operation of release rod 172. FIGS. 11B, 11D are views of table 100 prior to releasing the legs from the folded position.

FIG. 11D shows a bottom view of table 100 in a folded position. Legs 108, 110 are collapsed against table top 102. Leg 108 is engaged with hook 162 (not visible). Leg release button 194 is identified to differentiate it from table release lever 170. FIG. 11B shows table release lever 170 prior to it being depressed. FIG. 11C shows table release lever 170 being depressed and leg 108 disengaged from the mechanism to allow it to assume an expanded configuration.

Figures 12A, 12B:
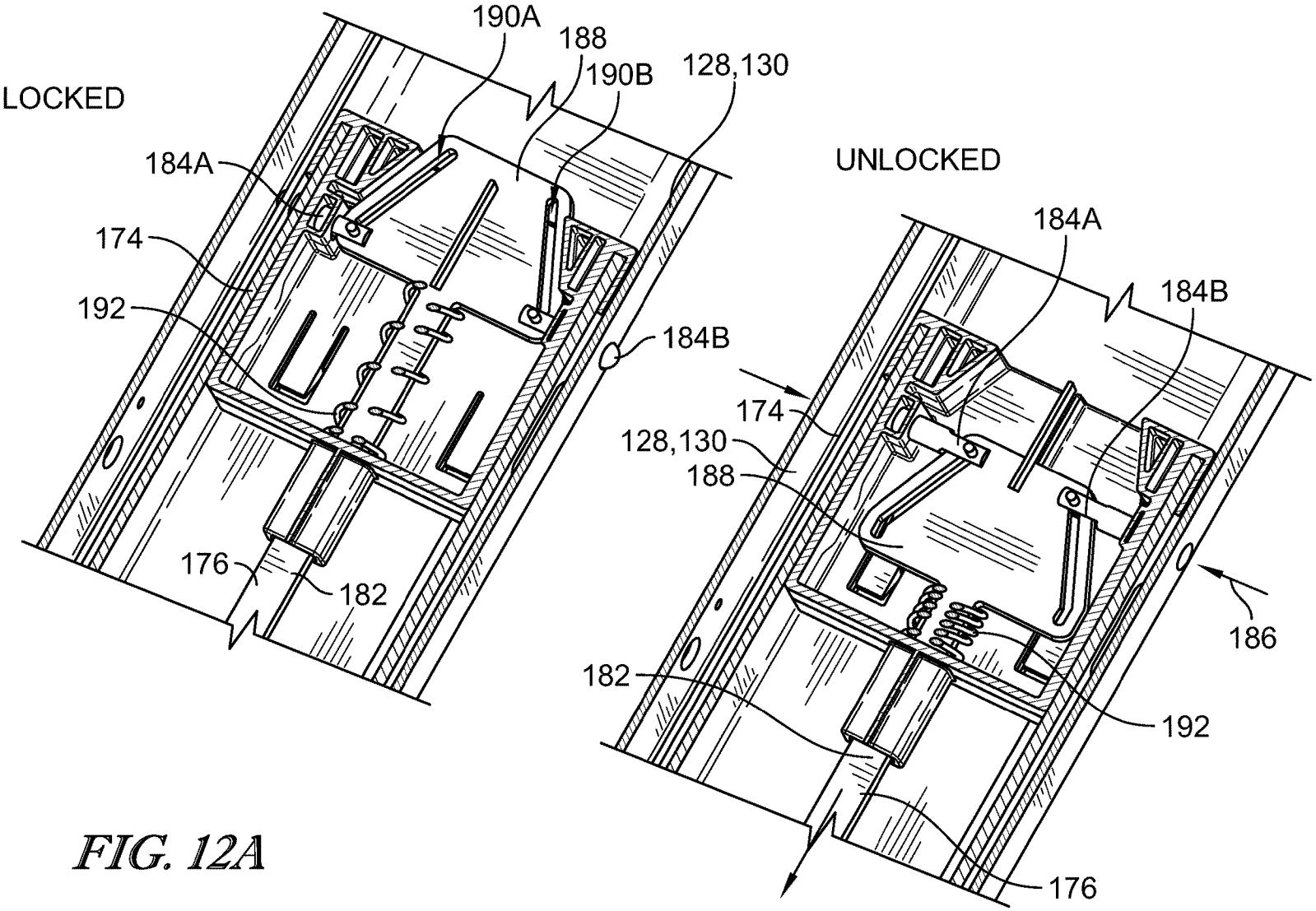
FIGS. 12A-B depict a top portion of the telescoping leg locking mechanism in a locked and unlocked configuration, respectively.
Figure 13A:
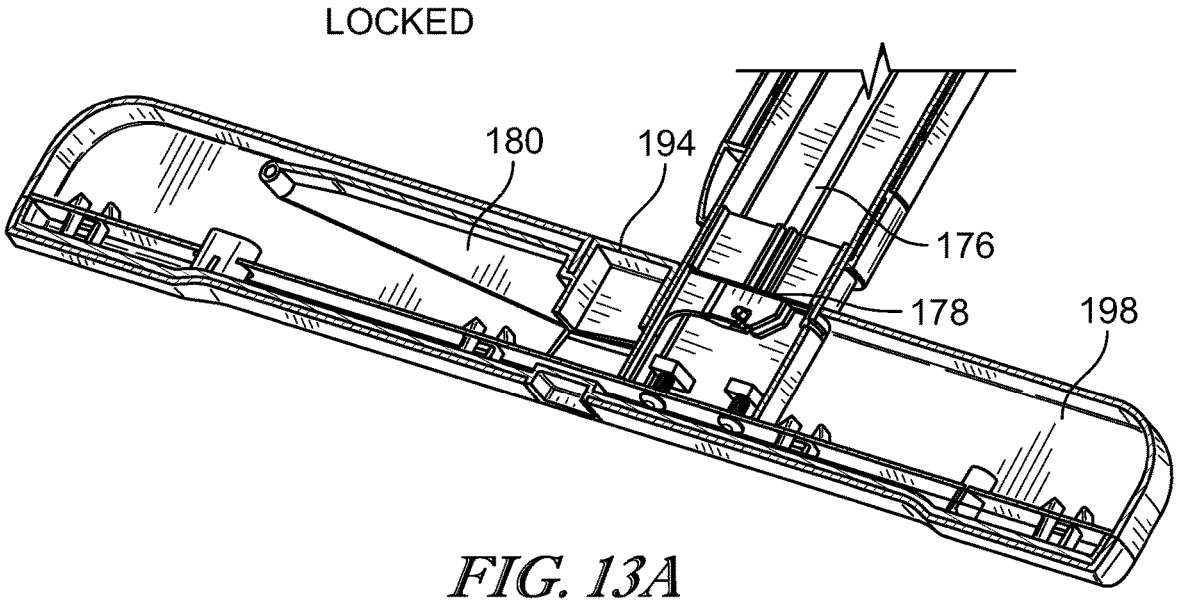
FIGS. 13A-B depict the bottom portion of the telescoping leg locking mechanism in a locked and unlocked configuration, respectively.
Figure 13B:
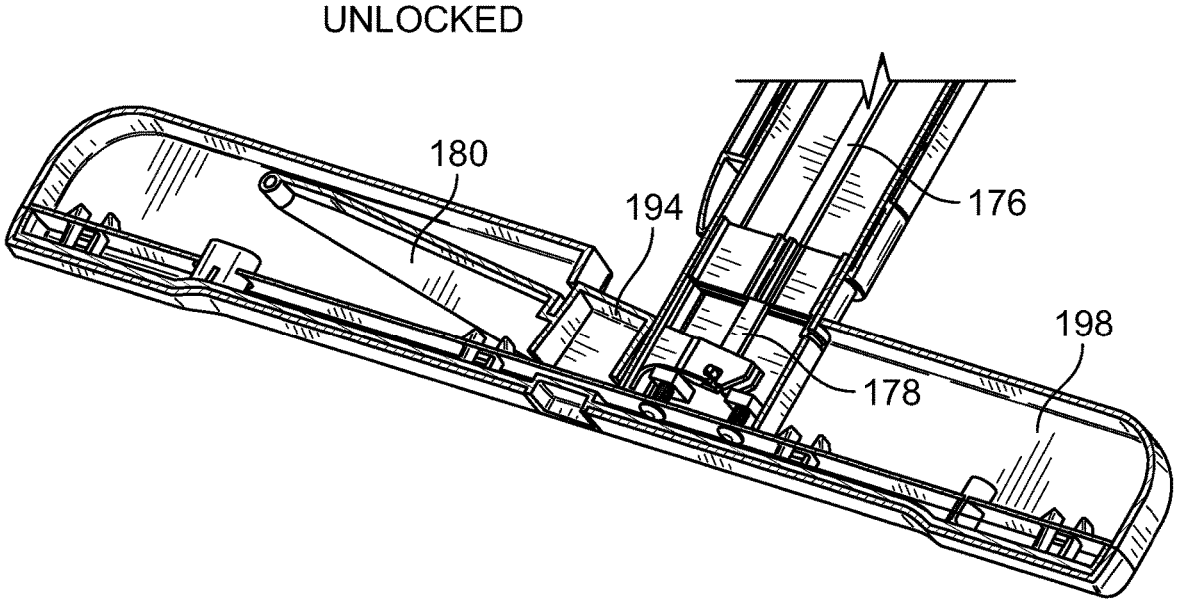

Table 100 includes a telescoping leg locking mechanism in each of first leg 108 second leg 110. FIGS. 12A-B depict a top portion of the telescoping leg locking mechanism in a locked and unlocked configuration, respectively. FIGS. 13A-B depict the bottom portion of the telescoping leg locking mechanism in a locked and unlocked configuration, respectively. The top and bottom portions are connected by connecting rod 176. The telescoping leg locking mechanism includes a lock housing 174 disposed within each leg extension section 128, 130. Lock housing 174 may snap into extension sections 128, 130. A connecting rod 176 is engaged at a first end 178 with a leg extension release lever 180 and engaged at a second end 182 with lock housing 174 or components therein. A pair of opposing pins 184A, 184B extend laterally through the lock housing 174 and are configured to engage with openings 186 in leg sleeve components 124, 126 to lock leg extension section 128, 130, respectively at a fixed height. When depressed, leg extension release lever 180 withdraws pins 184A, 184B from openings 186, thereby allowing leg extension sections 128, 130 to slide within leg sleeve components 124, 126.

A pin guide 188 extends from connecting rod 176. Pin guide 188 has opposing slots 190A, 190B angled with respect to the longitudinal side of extension leg sections 128, 130. A spring 192 is disposed around connecting rod 176 within lock housing 174 and contained within lock housing 174 by a housing wall. Spring 192 biases pin guide 188 to force pins 184A, 184B into openings 186 of sleeve components 124, 126. Release lever 180 is configured to move connecting rod 176 to compress spring 192 against lock housing 174, thereby withdrawing pins 184A, 184B from openings 186. In addition to the incremental lengthening and shortening of the legs, a continuous adjustment may be incorporated to allow any selection between a minimum and maximum length. Various telescoping mechanisms may be used for the legs, provided they do not interfere with the pivot apparatus.

Advantageously, telescoping legs 108, 110, together with pivot apparatus 208 allow table 100 to be elevated to a substantial height and folded compactly, without legs 108, 110 extending beyond the width of table top 102 (wherein the "width" is the greater of the table top dimensions). Therefore, a user need not give up height to achieve compactness. In an illustrative embodiment, table 100 has a width in the range of 750 mm to 1025 mm and the table height is in the range of about 1000 mm to about 1250 mm. In a particular embodiment, the table width is about 1000 mm and can reach a height of about 1124 mm and yet legs 108, 110 do not extend beyond the width of table top 102 when the table is collapsed. Various illustrative embodiments have a maximum height and maximum leg length greater than the width of the table, however, when in a folded configuration the legs do not extend beyond the width of the table while not being folded along their length. Disclosed embodiments also may lend themselves to lightweight, inexpensive construction, even for standing tables such as used in office environments.

Furthermore, table 100 is configured so that as it is elevated and second leg top end 118 slides across the width of table top 102 toward the first leg top end 112, and therefore, away from the opposing edge of table top 102, table 100 remains stable. The extent to which second leg top end 118 can slide toward first leg top end 112 can be balanced with the width of table top 102 to assure table 100 remains stable. The center of gravity in relation to the leg top ends 112, 118 and the leg bottom ends 114, 102 and the weight of table top 102 can be selected for optimum stability.

Figure 14A:
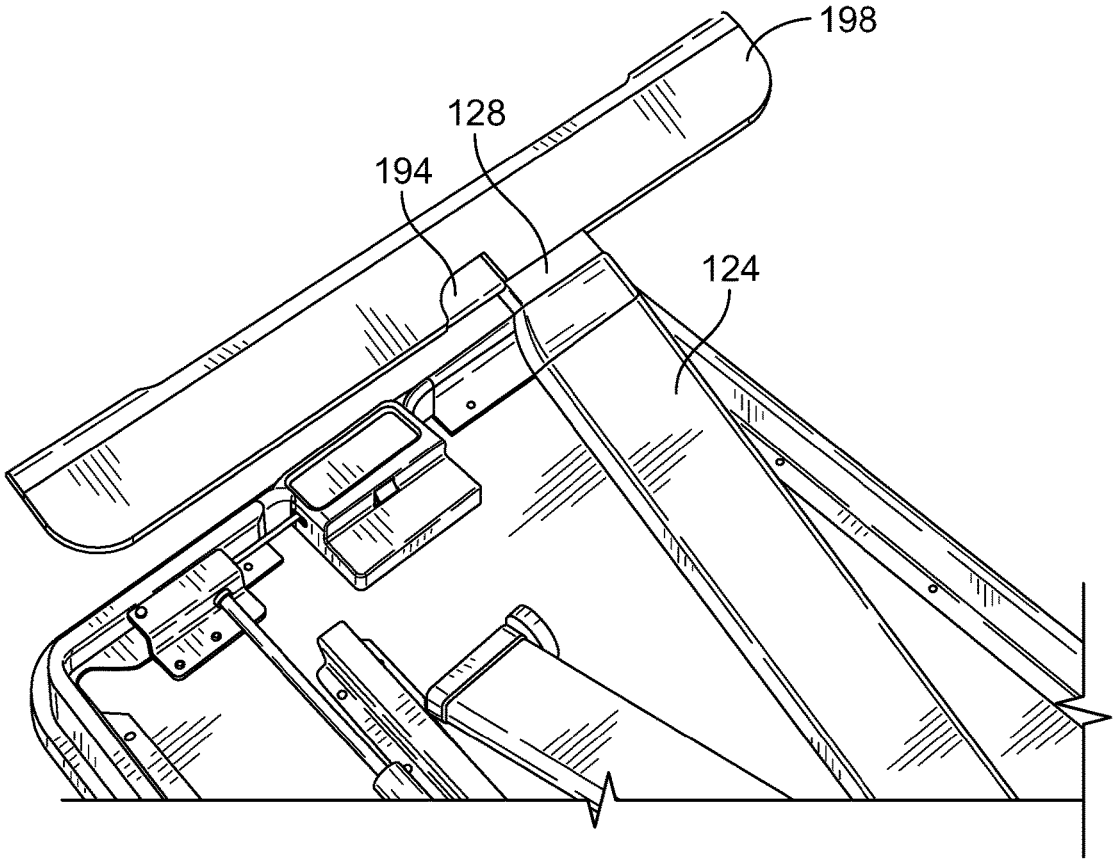
FIGS. 14A-B show an illustrative release mechanism for the telescoping legs of the adjustable height, foldable table.
Figure 14B:
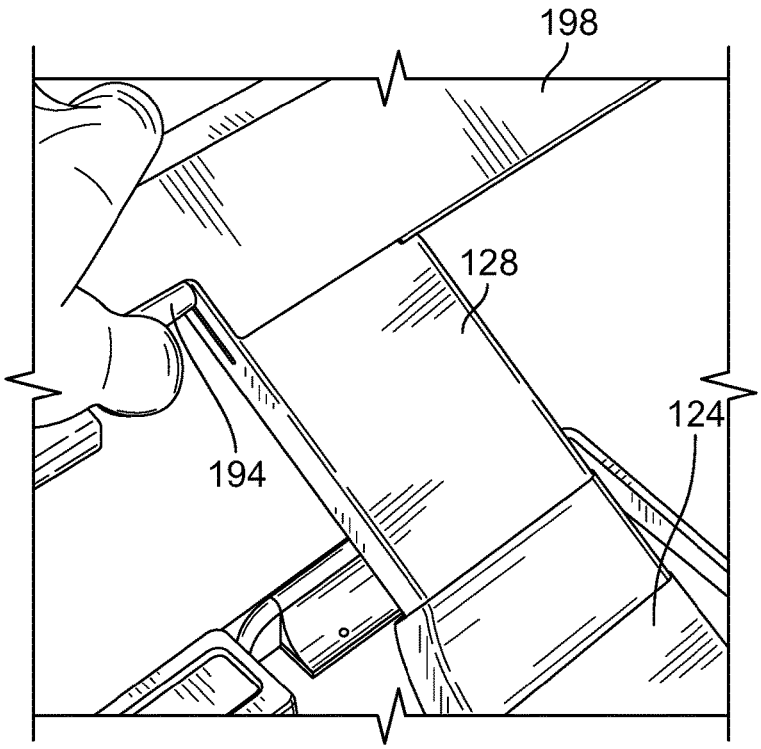

FIGS. 14A-B show an illustrative release mechanism for the telescoping legs. FIG. 14A depicts leg release button 194 positioned on a foot 198 attached to leg extension section 128. Foot 198 may be perpendicular to leg extension section 128. Other positions of leg release button 194 are possible, provided a user can readily depress the button and it can engage/disengage the leg sections. FIG. 14A shows leg extension section 128 fully nested in sleeve 124. FIG. 15C shows extension 128 partially withdrawn from sleeve 124, while leg release button 194 is depressed. Extension 128 may be withdrawn from sleeve 124 to a length necessary to provide the desired table height. Each of legs 108, 110 (see FIG. 1, for example) may have a release button for withdrawing the leg extension from the sleeve. Integrating release button 194 into the leg foot to actuate the associated telescoping leg lock mechanism, such as shown in FIGS. 14A-B, may provide an ergonomic configuration.

Figure 15A:
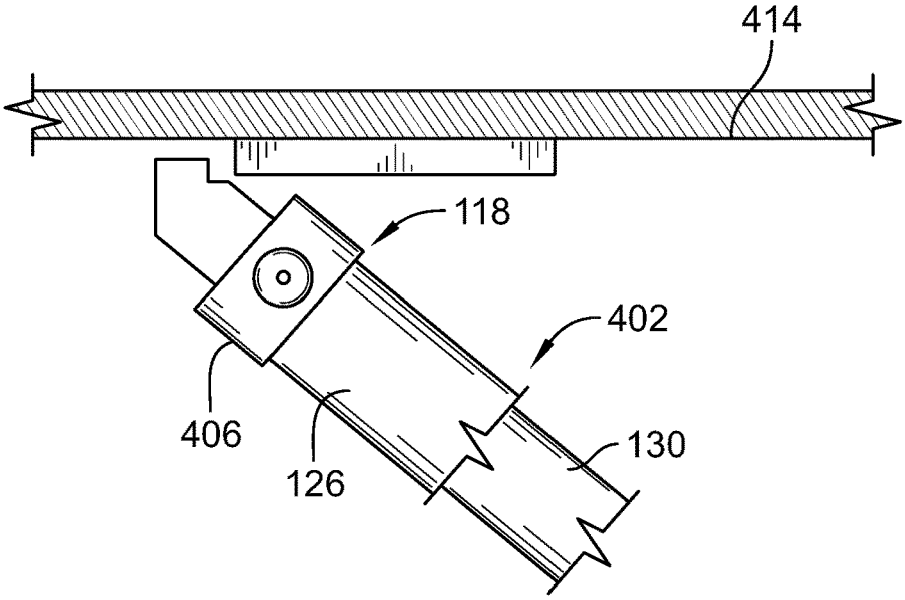
FIGS. 15A-B depict a range limiter to secure or position the adjustable height, foldable table at a particular height.
Figure 15B:
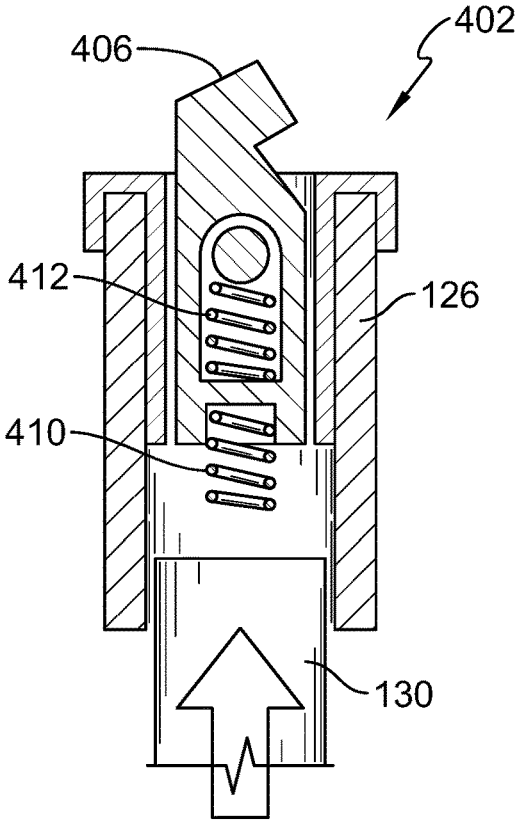

FIGS. 15A-B depict an illustrative stop 402, also referred to as a range limiter, attached to leg top end 118 of sleeve 126 for a coffee table height, for example. FIG. 15B shows a two-way spring-loaded plunger 406 positioned at the end of leg 408 for engagement with stop component 416. Stop component 416 is affixed to the bottom of a table top 414. When leg 408 is in a storage position, plunger 406 is pushed outward preventing table leg 408 from opening too far, i.e. from expanding to a height beyond a particular height, such as a coffee table height. FIG. 15B shows a cross-section of the plunger mechanism. Two springs are arranged in the mechanism with different forces or strengths associated with them. For simplicity, they will be referred to as a heavy spring 410 and a light spring 412, although these are used only as relative terms. Heavy spring 410 is implemented to add compliance to the system. As shown, the extension section of leg 408 pushes against heavy spring 410 when the table is collapsed, thereby pushing plunger 406 outward. Light spring 412 keeps plunger 406 withdrawn when leg 408 is extended. By limiting the position of leg 408 with respect to table top 414, a tendency for the table to tip when the legs are extended can be reduced or eliminated.

Figure 16:
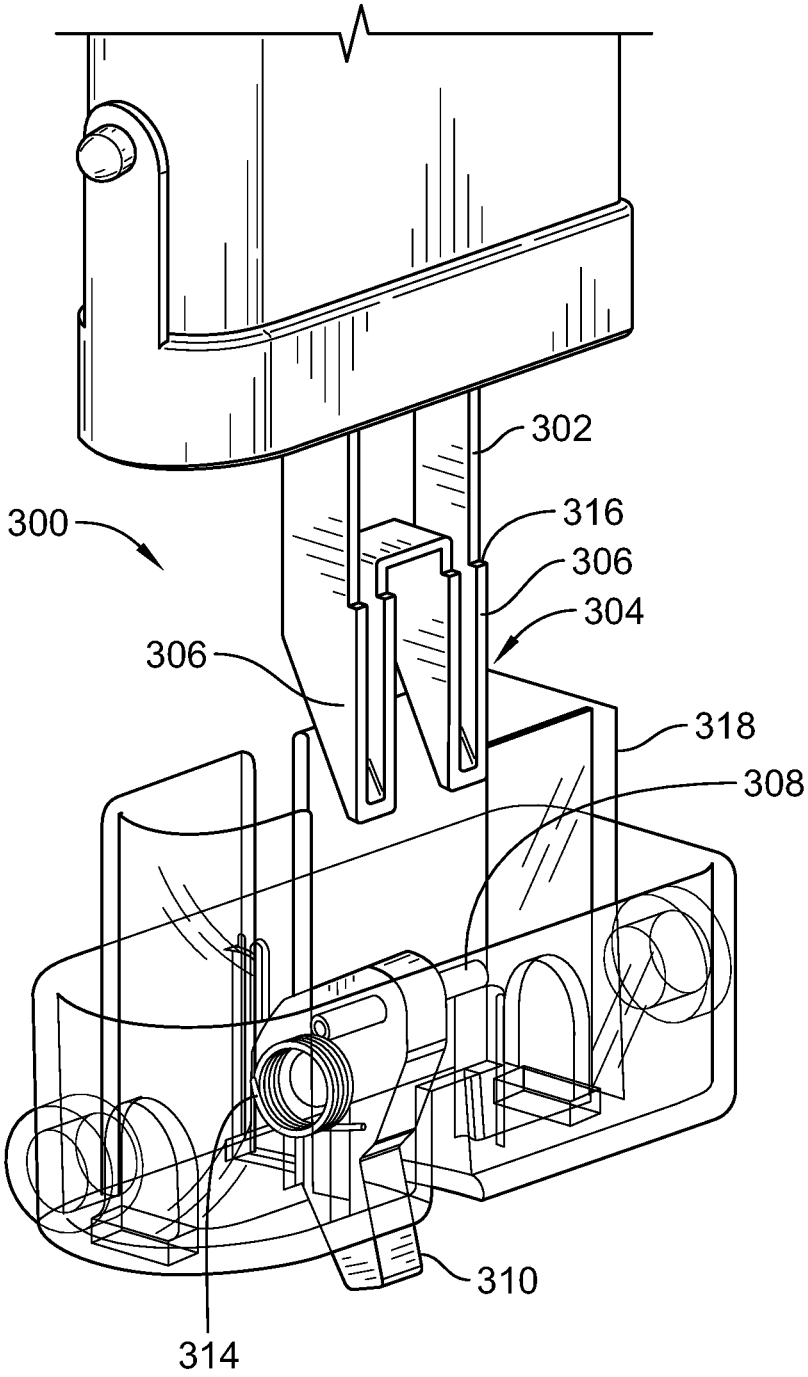
FIG. 16 depicts a further embodiment of a range limiter.

FIG. 16 depicts a further embodiment of a range limiter 300. Illustrative range limiter 300 includes a lock housing 302 that may be disposed, for example, toward or at the leg top end 118 of sleeve 126. Lock housing 302 has a forked component 304 with ramped ends 306. Ramped ends 306 engage a pin 308. Pin 308 is disposed through a latch 310. Pin 308 may be integral with latch 310 or attached in a manner other than being disposed through latch 310. Pin 308 may also consist of two pins. Pin 308 and latch 310 may also be a single combined part. Latch 310 is biased clockwise about pivot 312 by torsion spring 314.

Figure 17A:
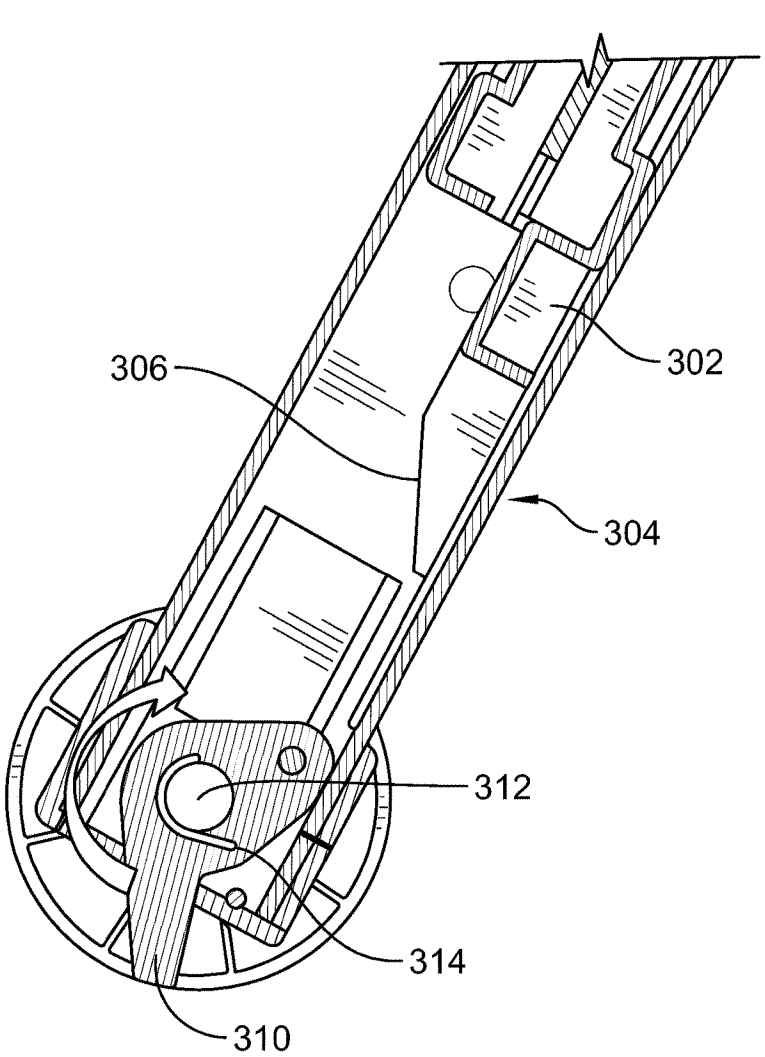
FIGS. 17A-B depict operation and components of the range limiter.
Figure 17A:
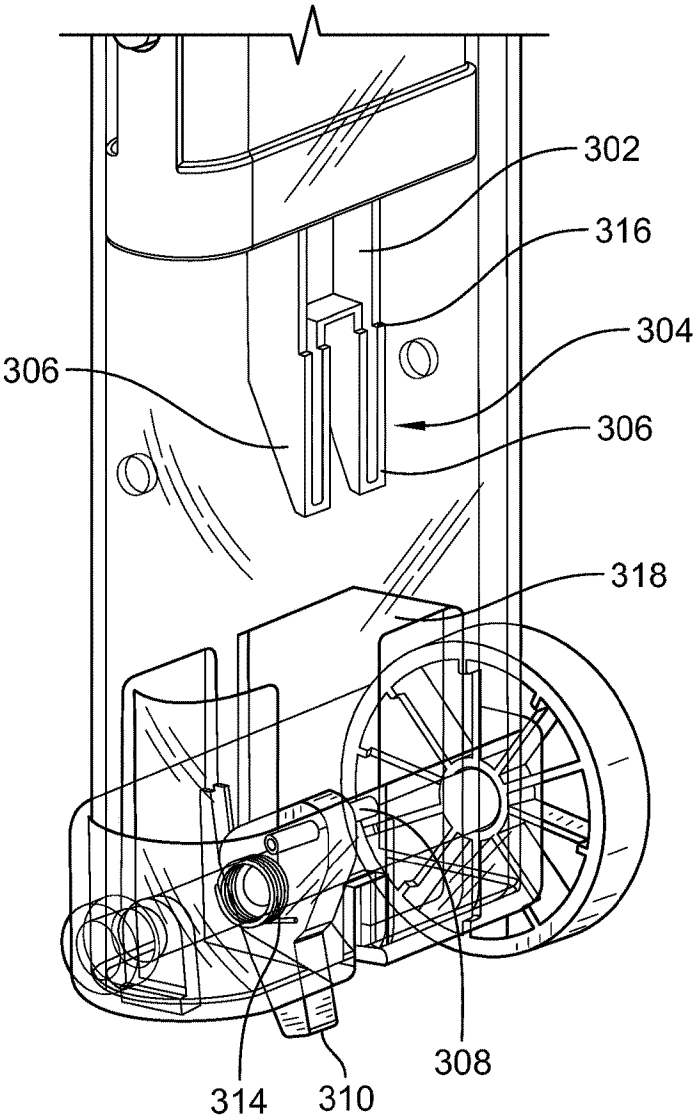
Figure 17B:
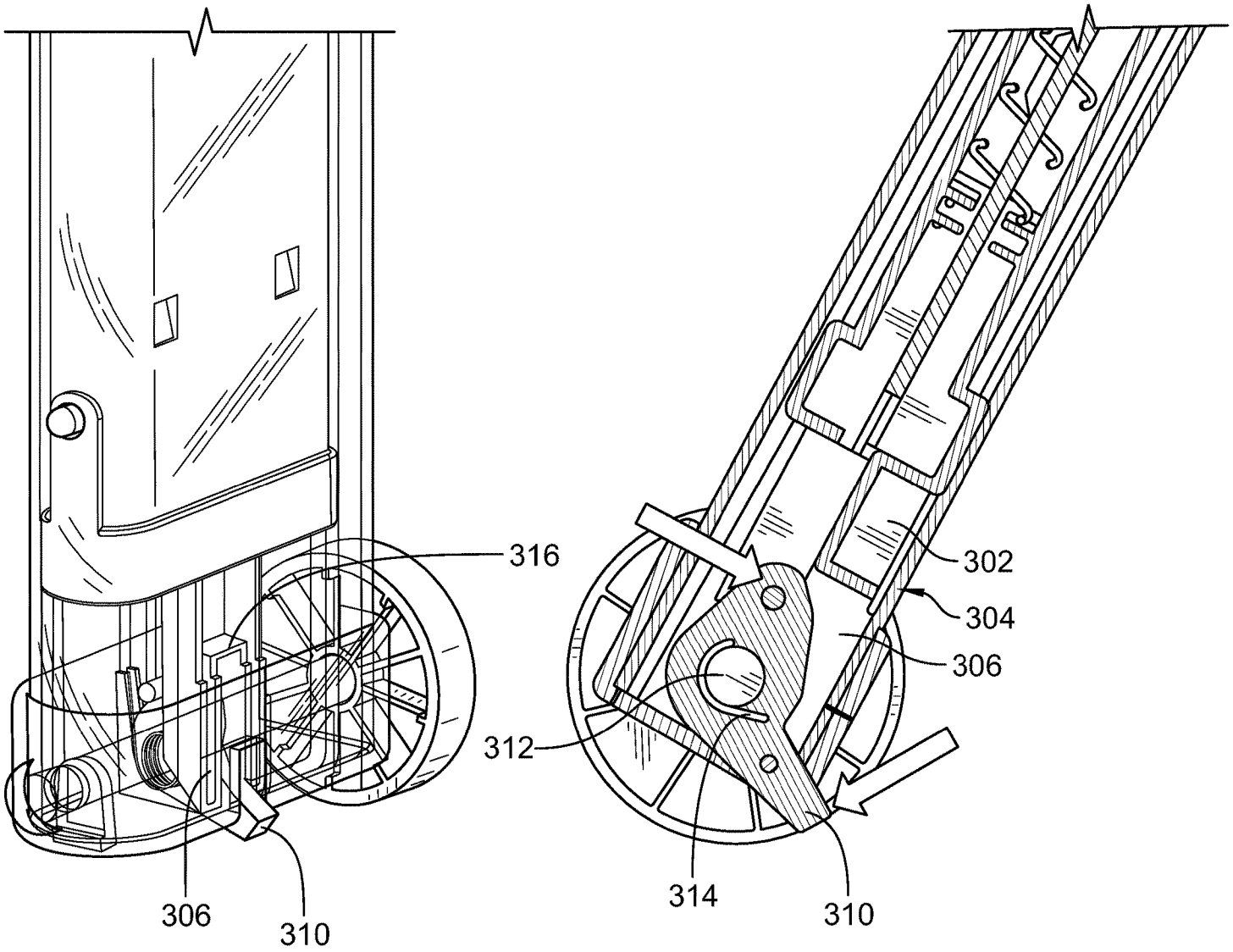

As shown in FIGS. 17A-B, as the table leg is collapsed, ramped ends 306 engage pin 308, forcing latch 310 to rotate counter clockwise about pivot 312 into a locked position. When the table leg is fully collapsed, pin 308 rests on a flat section 316 of forked component 304, preventing any force applied to latch 310 from being transferred to the inner leg in the direction of movement of the inner leg.

FIG. 17A depicts latch 310 biased by torsion spring 314 in a clockwise direction. Latch torsion spring 314 rests against an inner wall of a leg end cap 318 ("limiter housing"). Forked component 304 is shown displaced from leg end cap 318. Ramped ends 306 of forked component 304 have not yet engaged pin 308.

FIG. 17B shows ramped ends 306 of fork component 304 engaged with ramped ends 306 of forked component 304. Ramped ends 306 have reached their excursion limit at the bottom of leg end cap 318. Once the leg has collapsed fully, latch 310 can only apply force to the inner leg perpendicular to the direction of movement of the inner leg. This may only be relevant when latch 310 hits a stop component on the underside of the table top, because at that moment, the force from the gas spring (which is trying to raise the table) is being transferred through the latch. Because the resultant load applied by latch 310 onto lock housing 302 is perpendicular to the telescoping direction, latch 310 should not cause the telescoping lock mechanism to bind. In other words, the telescoping lock mechanism can function normally because latch 310 is unable to apply a load to the end cap 318 in a way that might cause the lock mechanism to bind.

Figure 18B:
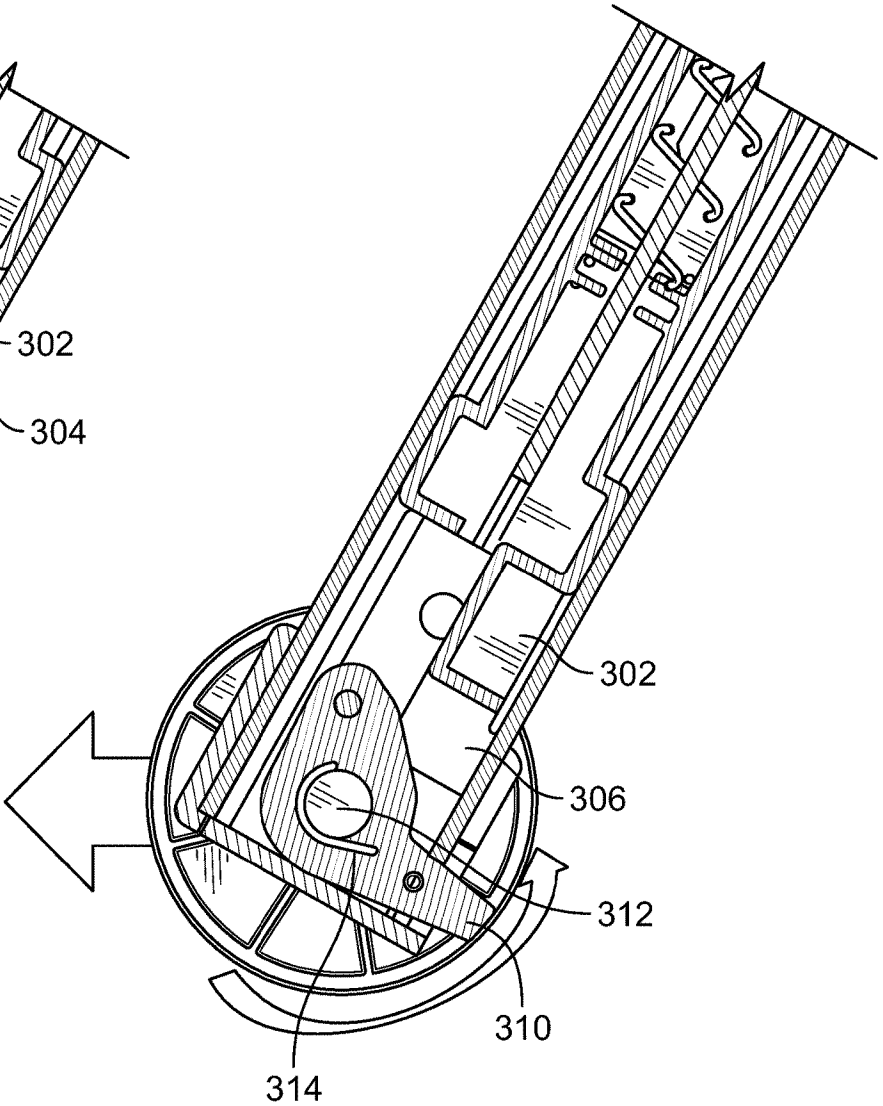
FIGS. 18A-B further illustrates operation and components of the range limiter.
Figure 18A:
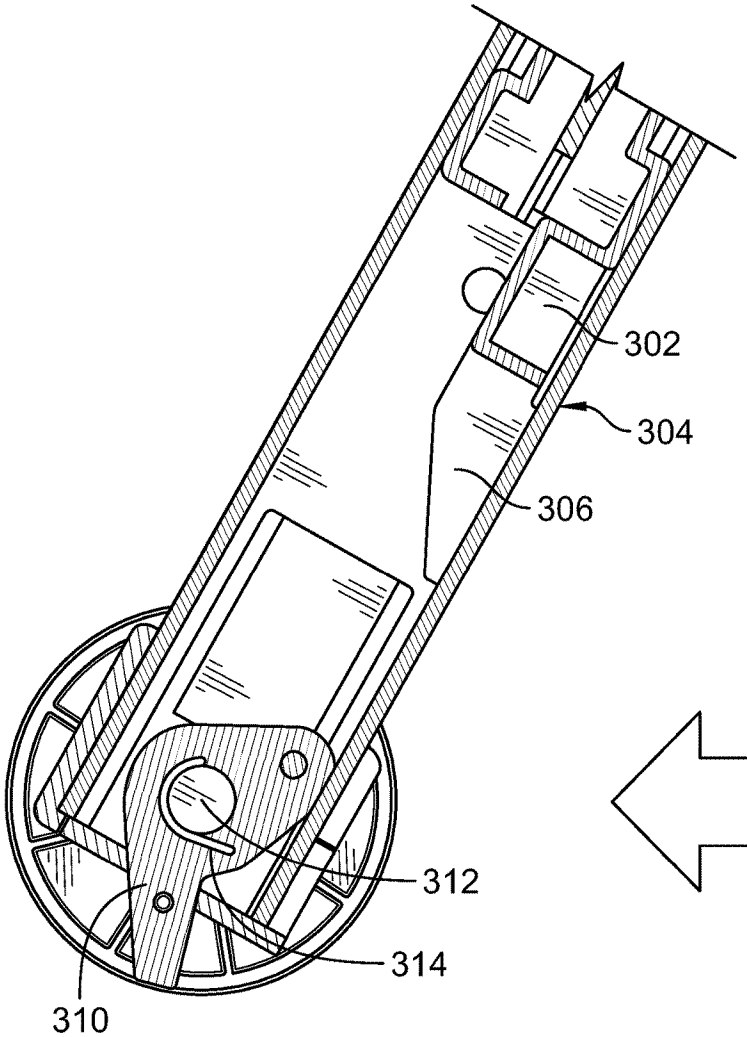

FIGS. 18A-B show two positions of latch 310. In FIG. 18A, ramped ends 306 have not engaged pin 308 so latch 310 is extended a maximum amount from the leg. In FIG. 18B, ramped ends 306 are fully engaged with pin 308 so latch 310 is rotated out of the way as the leg moves backwards over a limiter stop component.

Figure 19:
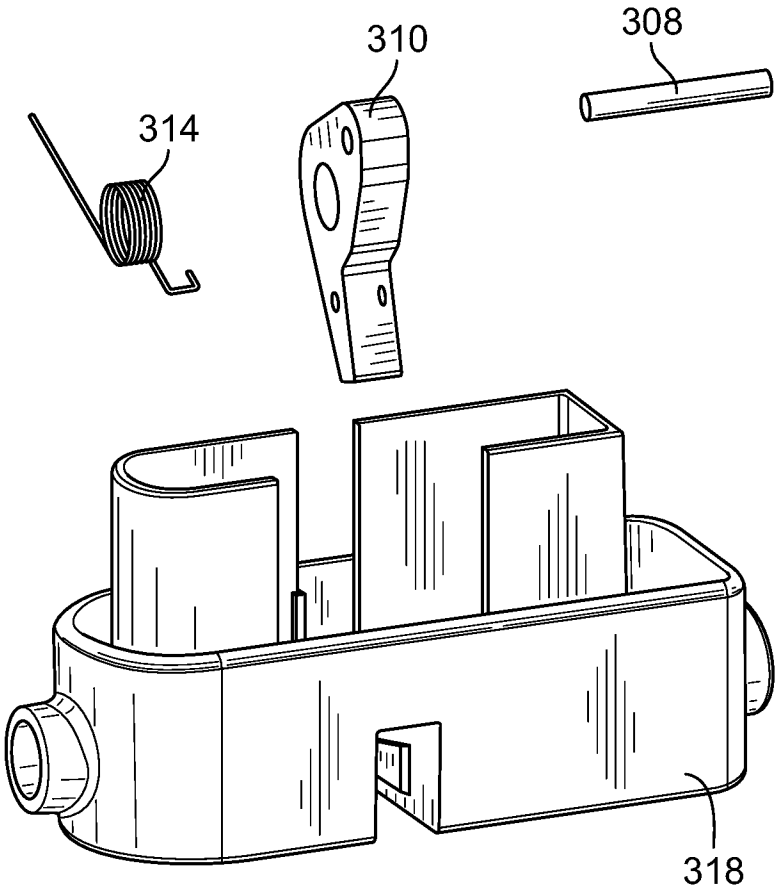
FIG. 19 depicts individual parts of the range limiter assembly.
Figure 19:
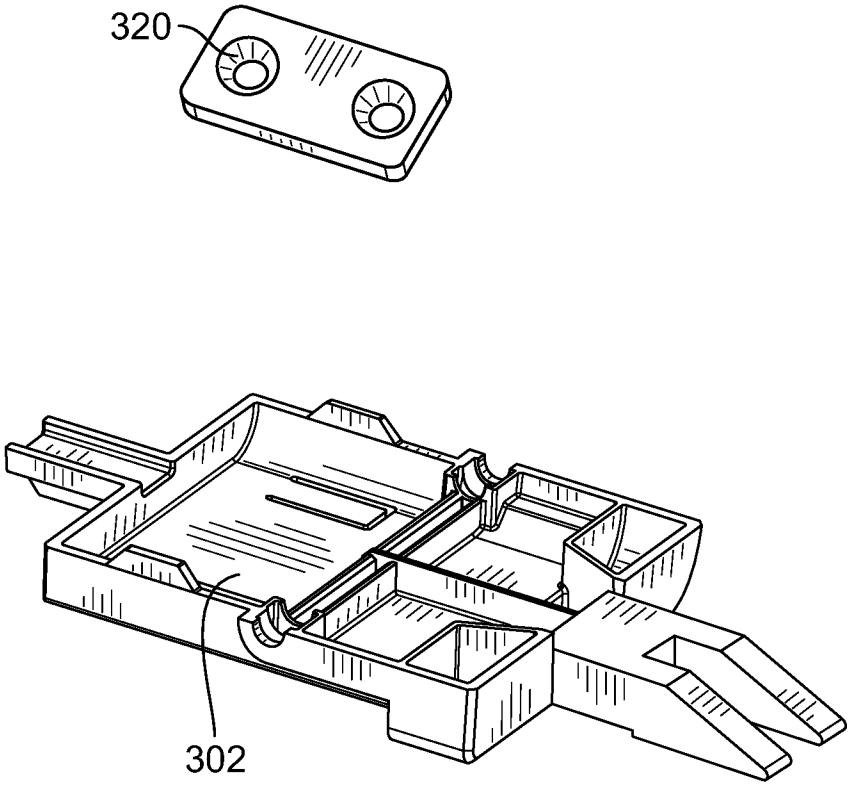

FIG. 19 depicts illustrative parts of the range limiter assembly. The parts include stop 320, which is affixed to the underside of the table top, torsion spring 314 to bias latch 310, latch 310, pin 308, which is disposed through latch 310 and torsion spring 314, lock housing 302 and leg end cap 318.

Figure 20:
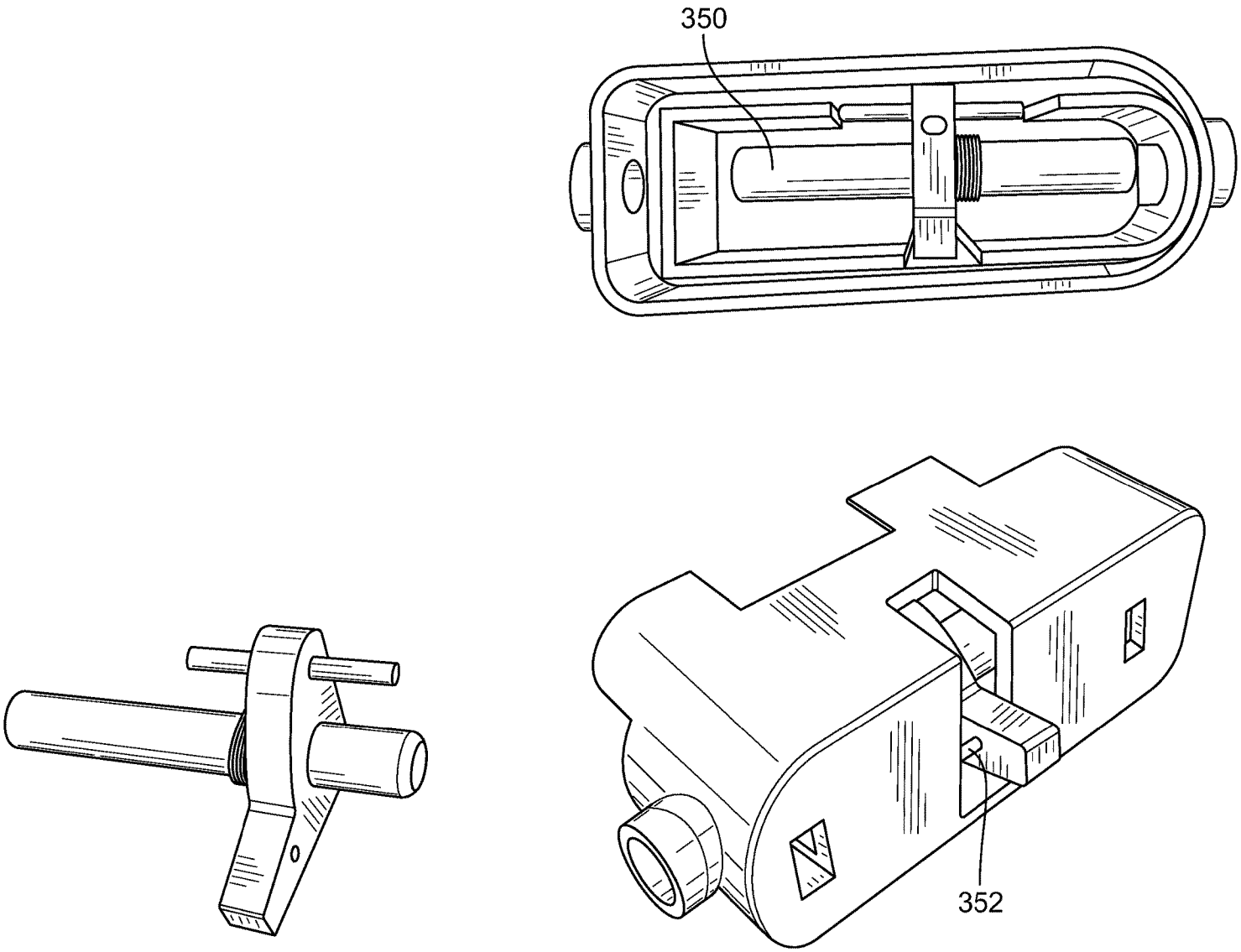
FIG. 20 depicts components of a system to simplify range limiter assembly.

FIG. 20 depicts components to simplify range limiter assembly. A push out mandrel 350 and an assembly pin 352 are fixtures used for holding latch 310 and torsion spring 314 in place while the subassembly is fitted onto leg top end 118 of sleeve 126 and attached to the table.

Figure 21A:
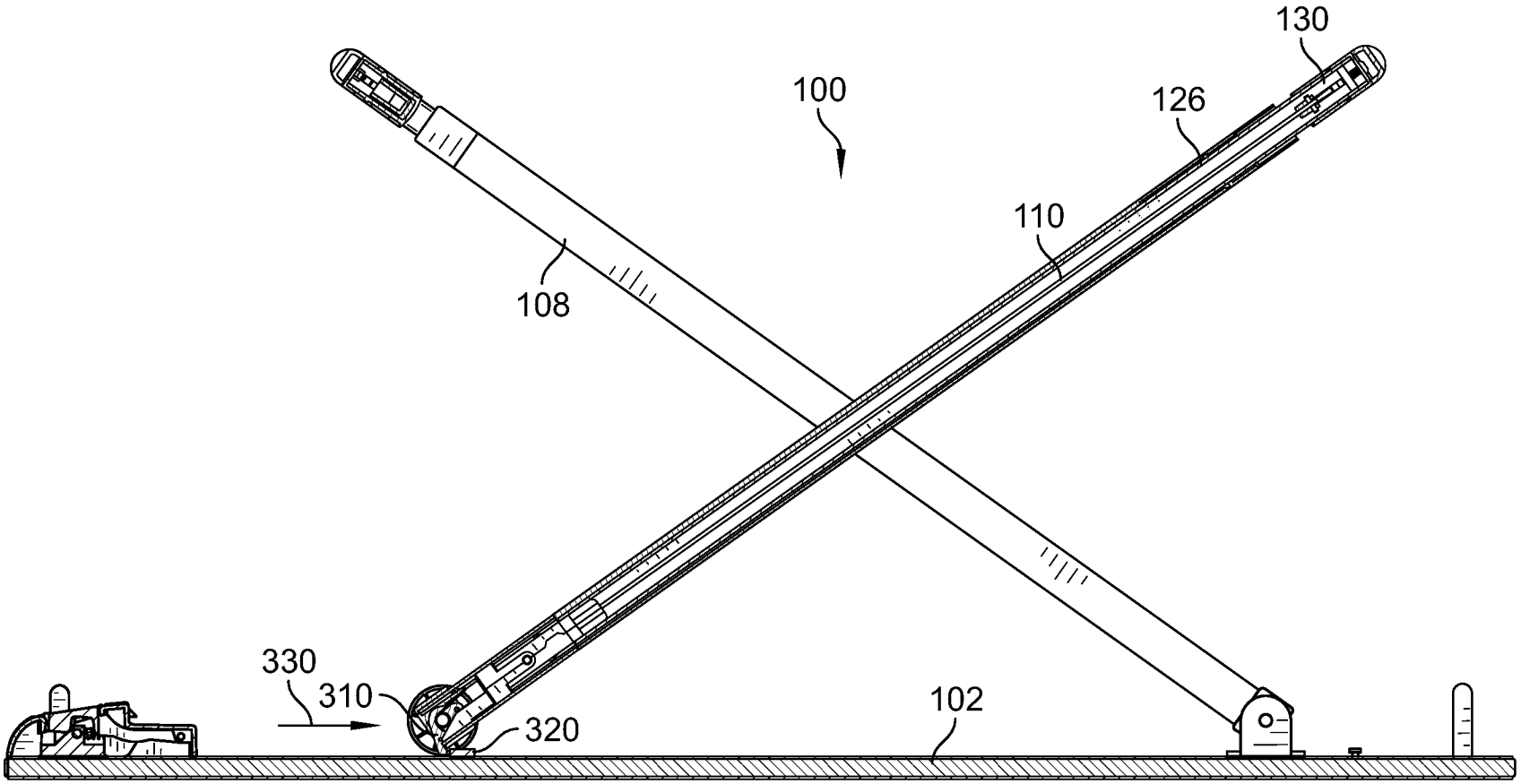
FIGS. 21A-G further depict operation of the range limiter assembly.
Figure 21B:
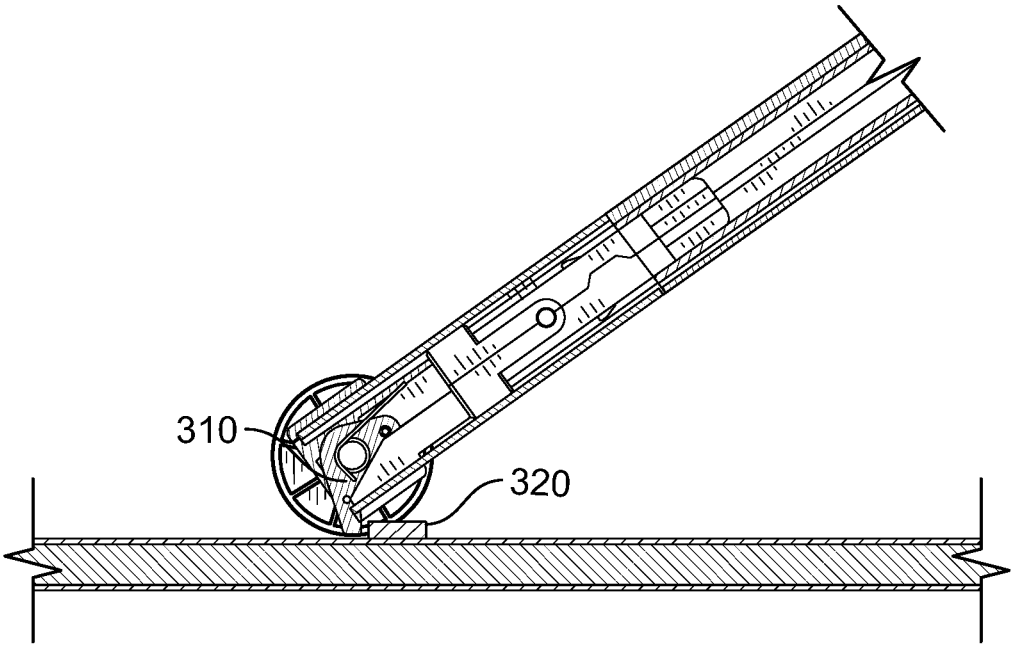
Figure 21C:
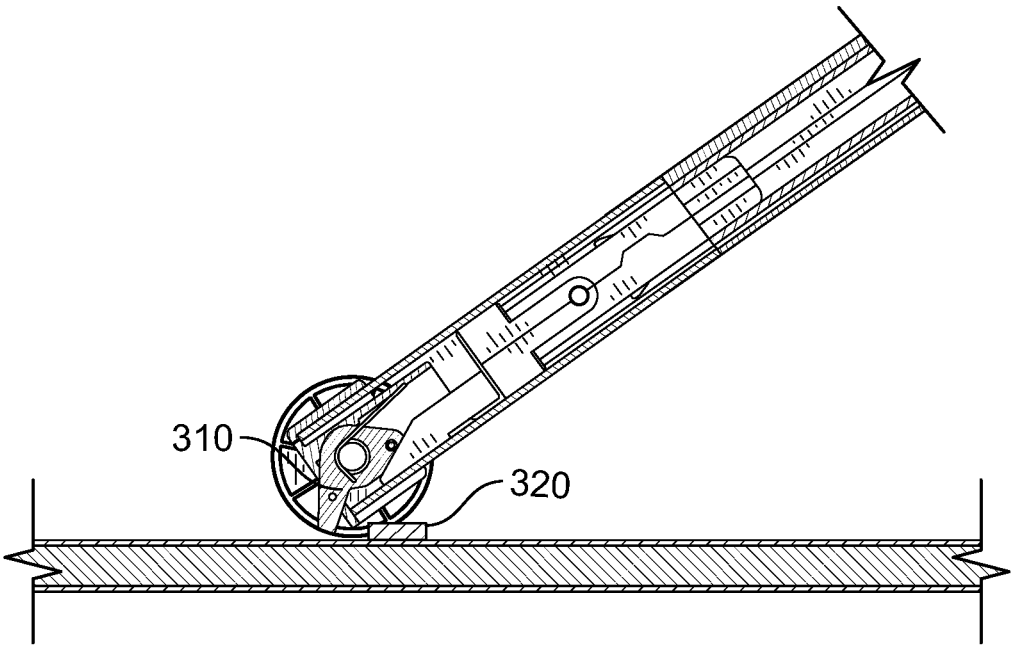
Figure 21D:
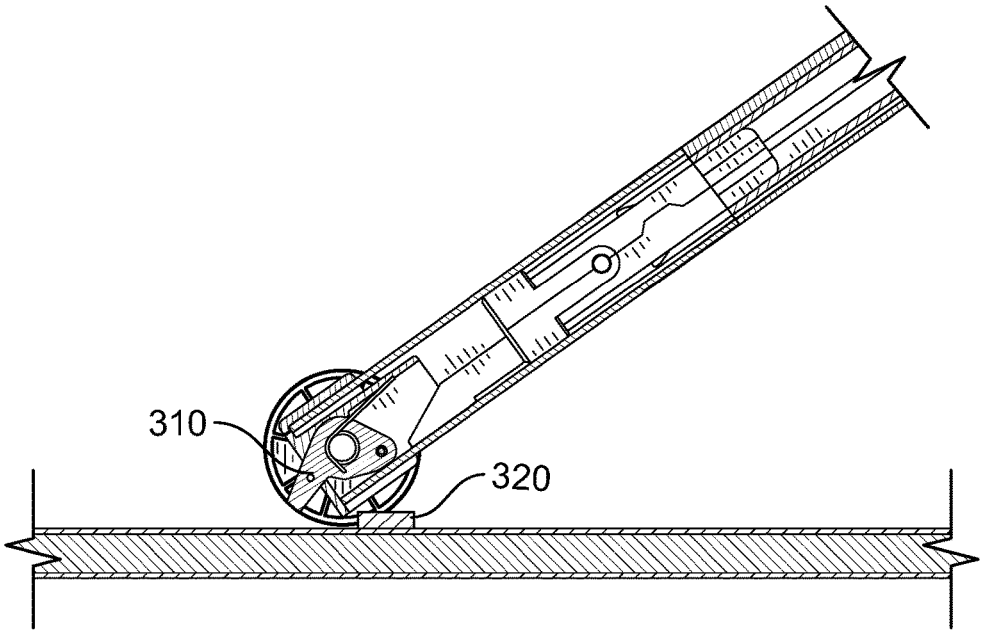
Figure 21E:
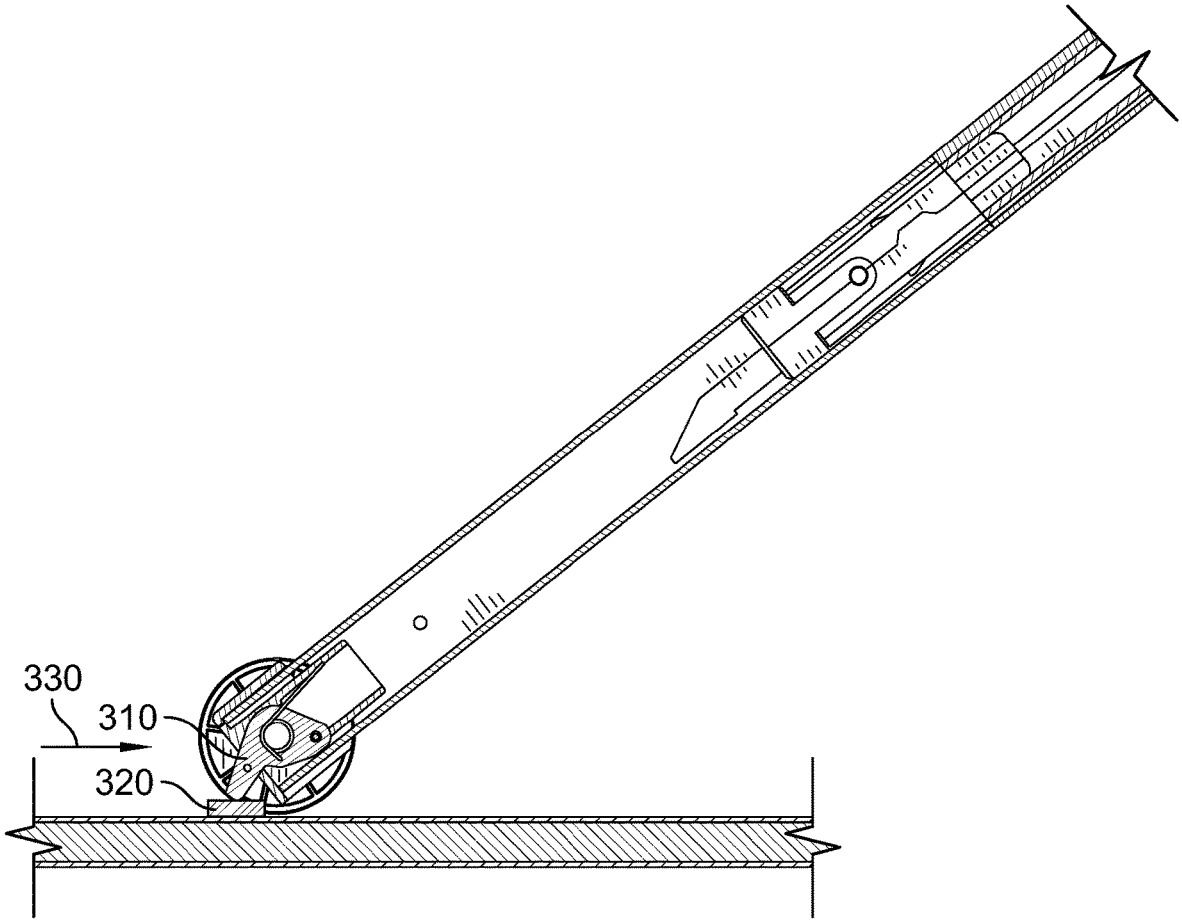

FIGS. 21A-G depict operation of a limiter assembly. FIG. 21A depicts a side view of a table 100 with its top side down. FIGS. 21B-21G depicts close-ups of limiter assembly during operation. FIG. 21A shows a limiter assembly approaching stop 320 in the direction of arrow 330. FIG. 21B shows latch 310 contacting stop 320. FIG. 21C depicts limiter operation as extension section 130 of second leg 110 extends from sleeve section 126. As extension section 130 extends from sleeve section 126, latch 310 rotates clockwise (as viewed in FIG. 21C) out of the way of stop 320. FIG. 21D shows further progression of the limiter assembly as extension section 130 extends further from sleeve section 126, resulting in latch 310 being completely open. FIG. 21E shows operation of the limiter assembly as extension section 130 becomes further extended from sleeve section 126, which rotates latch 310 further clockwise to an open position, allowing latch 310 to pass over stop 320.

Figure 21F:
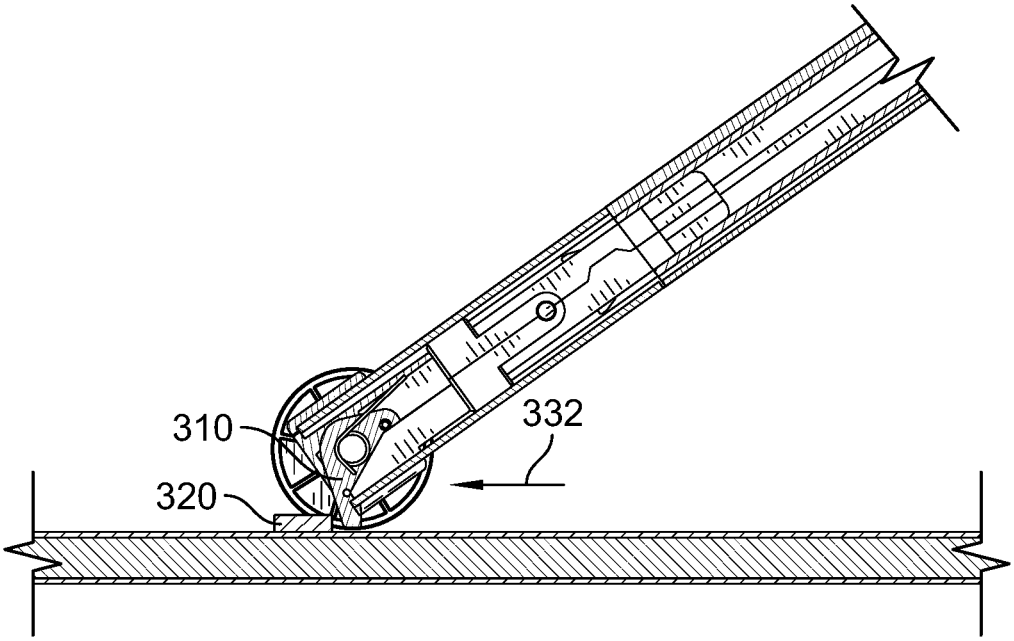
Figure 21G:
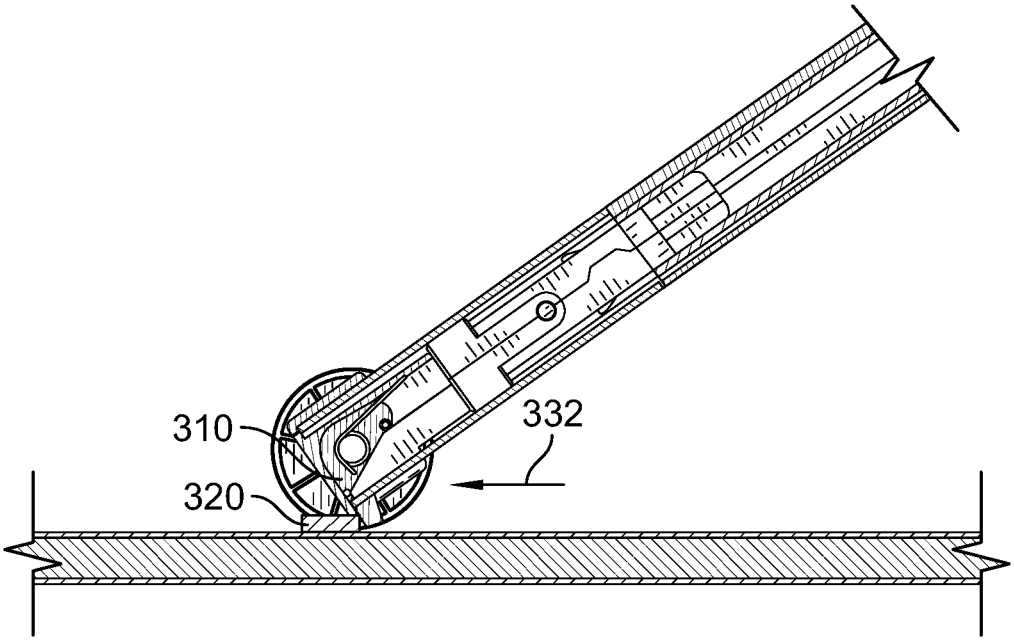

FIG. 21F shows latch 310 on the opposing side of stop 320 during collapse of leg 110. The limiter assembly is moving in the direction of arrow 332, which is toward a collapsed position. FIG. 21G shows latch 310 rotated sufficiently to prevent interference with stop 320, and thus allow legs 108, 110 to collapse toward table top 102. The torsion spring 314 provides the opposing torque on latch 310 as it is pushed backward over stop 320.

Although certain embodiments have been described and illustrated in exemplary forms with a certain degree of particularity, it is noted that the description and illustrations have been made by way of example only. Numerous changes in the details of construction and arrangement of parts and operations may be made. Additionally, various embodiments have been described, each having a different combination of elements. The invention is not limited to the specific embodiments disclosed, and may include different combinations of the elements disclosed, omission of some elements or the replacement of elements by the equivalents of such structures.

The invention claimed is:

1. A table comprising:

a table top having a top surface and a bottom surface;

a first leg having a top end and a bottom end, and a pivot located between the top end and the bottom end;

the first leg having a compartmentalized sleeve component and an extension section;

a second leg having a top end and a bottom end, and a pivot located between the top end and the bottom end;

the second leg having a compartmentalized sleeve component and an extension section;

the first leg top end fixedly attached to the table top bottom surface;

the second leg top end slidably attached to the table top bottom surface;

a pivot apparatus configured to attach the first leg to the second leg at the first leg pivot and the second leg pivot;

the first leg compartmentalized sleeve component divided longitudinally into a first space and an adjacent second space;

the second leg compartmentalized sleeve component divided longitudinally into a first space and an adjacent second space;

the first leg extension section beginning at the first leg bottom end and dimensioned to telescope into the first leg first space;

the second leg extension section beginning at the second leg bottom end and dimensioned to telescope into the second leg first space; and the pivot apparatus extending into the first leg second space and the second leg second space;

wherein the pivot apparatus comprises:

a nut positioned within the second enclosed space of each leg;

a male and female pivot component, wherein one of the male and female pivot components is positioned outside of the second enclosed space of one of the first leg and second leg, and the other of the male and female pivot components is positioned on the outside of the other of the first leg and second leg;

the male and female pivot components secured to the nuts.

2. The table of claim 1 comprising:

a track attached to the bottom surface of the table top;

a first wheel attached to the second leg top end configured to allow the second leg to slide along the table top bottom surface;

a second wheel laterally opposite the first wheel attached to the second leg top and disposed within the track and slidable along the track;

a pull bar to which the second wheel is rotationally attached;

a compression spring having a first end and a second end;

the spring first end fixedly attached to the table top bottom surface or an extension therefrom; and the spring second end fixedly attached to the pull bar, thereby forcing the spring to compress when the table is collapsed and extended as the table is raised.

3. The table of claim 1 further comprising a locking and release mechanism to secure the table in a folded position, the locking and release mechanism comprising:

a storage catch having a hook pivotably attached to the table top;

an indent in the first leg bottom complementary to the storage catch hook;

the storage catch biased to engage the first leg bottom indent;

a shuttle slidable in the locking and release mechanism from a first position engaging the storage catch and countering the bias of the storage catch toward the first leg bottom indent to unlock the first leg bottom, and a second position away from the storage catch so as not to affect the bias of the storage catch toward the first leg bottom indent;

the shuttle having an angled surface;

a release lever movable toward and away from the table top and engaged with the shuttle angled surface so as to force the shuttle to move or away from the storage catch according to the engagement position of the release lever with respect to the shuttle.

4. The table of claim 3 wherein the locking and release mechanism further comprises:

a release rod;

the release rod configured to release a gas spring release component to allow the gas spring to expand, thereby elevating the table.

5. The table of claim 1 further comprising:

a telescoping leg locking mechanism in each of the first leg and the second leg, the telescoping leg locking mechanism having:

a lock housing disposed within each leg extension section;

a connecting rod engaged at a first end with a leg extension release lever and engaged at a second end with the lock housing or components therein; and a pair of opposing pins extendable laterally through the housing and configured to engage with openings in the leg compartmentalized sleeve component to lock the leg extension at a fixed height;

wherein, when depressed, the leg extension release lever withdraws the pins from the openings, thereby allowing the leg extension to slide within the leg compartmentalized sleeve component.

6. The table of claim 5 comprising:

a pin guide extending from the connecting rod;

the pin guide having opposing slots angled with respect to longitudinal side of the extension leg component; and a spring disposed around the connecting rod within the housing and contained within the housing by a housing wall, the spring biasing the pin guide to force the pins into the openings of the compartmentalized sleeve component;

wherein the release lever is configured to compress the spring thereby withdrawing the pins from the openings.

7. The table of claim 1 further comprising a pivot housing, the pivot housing having;

a first leg pivot component having an opening through which the first leg compartmentalized sleeve component is disposed; and a second leg pivot component having an opening through which the second leg compartmentalized sleeve component is disposed;

wherein the first leg pivot component is rotatably attached to the second leg pivot component.

8. The table of claim 7 wherein each leg extension section is extendable within its associated compartmentalized sleeve component past the pivot apparatus.

9. The table of claim 1 further comprising a range limiter assembly.

10. The table of claim 9 wherein the range limiter assembly comprises:

a stop affixed to the underside of the table top;

a rotatable latch;

the rotatable latch connected to the extension section of the second leg and configured to either engage with or clear the stop when the extension section is extended from the sleeve section.

11. A table comprising:

a table top having a top surface and a bottom surface;

a first leg having a top end and a bottom end, and a pivot located between the top end and the bottom end;

the first leg having a compartmentalized sleeve component and an extension section;

a second leg having a top end and a bottom end, and a pivot located between the top end and the bottom end;

the second leg having a compartmentalized sleeve component and an extension section;

the first leg top end fixedly attached to the table top bottom surface;

the second leg top end slidably attached to the table top bottom surface;

a pivot apparatus configured to attach the first leg to the second leg at the first leg pivot and the second leg pivot;

the first leg compartmentalized sleeve component divided longitudinally into a first space and an adjacent second space;

the second leg compartmentalized sleeve component divided longitudinally into a first space and an adjacent second space;

the first leg extension section beginning at the first leg bottom end and dimensioned to telescope into the first leg first space;

the second leg extension section beginning at the second leg bottom end and dimensioned to telescope into the second leg first space;

the pivot apparatus extending into the first leg second space and the second leg second space;

a locking and release mechanism to secure the table in a folded position, the locking and release mechanism comprising:

a storage catch having a hook pivotably attached to the table top;

an indent in the first leg bottom complementary to the storage catch hook;

the storage catch biased to engage the first leg bottom indent; and a shuttle slidable in the locking and release mechanism from a first position engaging the storage catch and countering the bias of the storage catch toward the first leg bottom indent to unlock the first leg bottom, and a second position away from the storage catch so as not to affect the bias of the storage catch toward the first leg bottom indent;

the shuttle having an angled surface; and a release lever movable toward and away from the table top and engaged with the shuttle angled surface so as to force the shuttle to move or away from the storage catch according to the engagement position of the release lever with respect to the shuttle.

12. The table of claim 11 wherein the locking and release mechanism further comprises:

a release rod;

the release rod configured to release a gas spring release component to allow the gas spring to expand, thereby elevating the table.

13. A table comprising:

a table top having a top surface and a bottom surface;

a first leg having a top end and a bottom end, and a pivot located between the top end and the bottom end;

the first leg having a compartmentalized sleeve component and an extension section;

a second leg having a top end and a bottom end, and a pivot located between the top end and the bottom end;

the second leg having a compartmentalized sleeve component and an extension section;

the first leg top end fixedly attached to the table top bottom surface;

the second leg top end slidably attached to the table top bottom surface;

a pivot apparatus configured to attach the first leg to the second leg at the first leg pivot and the second leg pivot;

the first leg compartmentalized sleeve component divided longitudinally into a first space and an adjacent second space;

the second leg compartmentalized sleeve component divided longitudinally into a first space and an adjacent second space;

the first leg extension section beginning at the first leg bottom end and dimensioned to telescope into the first leg first space;

the second leg extension section beginning at the second leg bottom end and dimensioned to telescope into the second leg first space;

the pivot apparatus extending into the first leg second space and the second leg second space;

a telescoping leg locking mechanism in each of the first leg and the second leg, the telescoping leg locking mechanism having:

a lock housing disposed within each leg extension section;

a connecting rod engaged at a first end with a leg extension release lever and engaged at a second end with the lock housing or components therein; and a pair of opposing pins extendable laterally through the housing and configured to engage with openings in the leg compartmentalized sleeve component to lock the leg extension at a fixed height;

wherein, when depressed, the leg extension release lever withdraws the pins from the openings, thereby allowing the leg extension to slide within the leg compartmentalized sleeve component.

14. The table of claim 13 comprising:

a pin guide extending from the connecting rod;

the pin guide having opposing slots angled with respect to longitudinal side of the extension leg component; and a spring disposed around the connecting rod within the housing and contained within the housing by a housing wall, the spring biasing the pin guide to force the pins into the openings of the compartmentalized sleeve component;

wherein the release lever is configured to compress the spring thereby withdrawing the pins from the openings.

15. The table of claim 14 further comprising a pivot housing, the pivot housing having;

a first leg pivot component having an opening through which the first leg compartmentalized sleeve component is disposed; and a second leg pivot component having an opening through which the second leg compartmentalized sleeve component is disposed;

wherein the first leg pivot component is rotatably attached to the second leg pivot component.

16. The table of claim 15 wherein each leg extension section is extendable within its associated compartmentalized sleeve component past the pivot apparatus.

17. The table of claim 16 further comprising a range limiter assembly wherein the range limiter assembly comprises:

a stop affixed to the underside of the table top;

a rotatable latch;

the rotatable latch connected to the extension section of the second leg and configured to either engage with or clear the stop when the extension section is extended from the sleeve section.

* * * * *